US005634731A

United States Patent [19]

Kita et al.

[11] Patent Number: 5,634,731

[45] Date of Patent: Jun. 3, 1997

[54] METHOD AND APPARATUS FOR THERMAL TRANSFER PRINTING

[75] Inventors: Tatsuya Kita; Jitsuhiko Ando; Naoji Shibasaki, all of Tokyo-to, Japan

[73] Assignee: Dai Nippon Printing Co., Ltd., Japan

[21] Appl. No.: 400,231

[22] Filed: Mar. 6, 1995

[30] Foreign Application Priority Data

| | | | |
|---|---|---|---|
| Mar. 4, 1994 | [JP] | Japan | 6-060254 |
| Jun. 27, 1994 | [JP] | Japan | 6-165842 |
| Jul. 11, 1994 | [JP] | Japan | 6-180482 |

[51] Int. Cl.[6] ..... B41J 2/325

[52] U.S. Cl. ..... 400/120.18; 347/213; 400/249

[58] Field of Search ..... 400/120.01, 120.08, 400/120.18, 249, 703, 708; 347/177, 212, 213, 218, 219

[56] References Cited

FOREIGN PATENT DOCUMENTS

| | | | |
|---|---|---|---|
| 61-106273 | 5/1986 | Japan | 347/213 |
| 62-238791 | 10/1987 | Japan . | |

*Primary Examiner*—David A. Wiecking

*Attorney, Agent, or Firm*—Parkhurst, Wendel & Burr, L.L.P.

[57] ABSTRACT

For thermal transfer printing, a coloring material image is thermally migrated from a thermal transfer printing sheet having a coloring material layer thereon onto an image forming area of an image-receiving layer of an intermediate transfer recording medium. The image on the recording medium is then thermally transfer-printed under pressure on a printing sheet in an image transfer section. A detection mark is provided on the intermediate transfer recording medium. This detection mark is detected for positioning an image forming area of the recording medium relative to a thermal head of the printer. In a case where the image forming section and the image transfer section are arranged in a line, a buffer unit is provided in which the recording medium being fed continuously between the two sections is caused to take a detouring path whereby mutual influence of the two sections is prevented. A line heater can be used as heating means in the image transfer section.

25 Claims, 16 Drawing Sheets

METHOD AND APPARATUS FOR THERMAL TRANSFER PRINTING

BACKGROUND OF THE INVENTION

The present invention relates to a method of and an apparatus for thermal transfer recording, comprising transference to a printing sheet of an image-receiving layer of an intermediate transfer recording medium having an image recorded thereon by means of thermal transfer recording.

Heretofore, there have been proposed heat transfer printing processes which comprise the steps of bringing a thermal transfer printing sheet, comprising a coloring material layer provided at least on one surface of a substrate sheet, and an image-receiving material of an image-receiving layer of a sheet into pressure contact with each other between a heating device such as a thermal head and a platen roller, and transferring a coloring material contained in the coloring material layer of the thermal transfer printing sheet to the image-receiving material by heat which is selectively generated by the heating portions of the heating device according to image information for recording an image on the image-receiving material. Among these processes, a hot-melt transfer printing process and a heat sublimation transfer printing process have been widely employed.

The hot-melt transfer printing process is a method for forming an image in which use is made of a thermal transfer printing sheet obtained by providing, on a substrate sheet such as a plastic film, a hot-melt ink layer which contains a coloring material such as a pigment dispersed in a binder such as a hot-melt wax or resin; the coloring material is transferred, together with the binder, to an image-receiving material such as paper or a plastic sheet to form an image thereon by means of a heating device such as a thermal head to which energy is applied according to image information. The image formed in the hot-melt transfer printing process has a high density, and is excellent in sharpness. This printing process is therefore suitable for the recording of binary images such as letters and line drawings. Further, it is also possible to form a multi-colored or full-colored image by using thermal transfer printing sheets of yellow, magenta, cyan and black, placing the colors one over another on an image-receiving material.

The heat sublimation transfer printing process is a method for recording an image in which use is made of a thermal transfer printing sheet prepared by providing, on a substrate sheet such as a plastic film, a dye layer which contains a sublimable dye serving as a coloring material dissolved or dispersed in a binder resin, and an image-receiving material prepared by providing an image-receiving layer on a substrate sheet such as paper or a plastic sheet; the sublimable dye contained in the dye layer of the thermal transfer printing sheet is transferred to the image-receiving layer of the image-receiving material to form an image thereon by means of a heating device such as a thermal head to which energy is applied according to image information.

In the heat sublimation transfer printing process, the amount of a dye to be transferred can be controlled in every dot on a thermal head by the amount of energy applied to a thermal transfer printing sheet. For this reason, the gradation of an image can be reproduced by the gradual change of density. Further, since the coloring material used in this process is a dye, the image formed is transparent, and a half tone which is obtained by placing dyes of different colors one over another can also be excellently reproduced. Therefore, a high-quality full-colored image can be obtained by using thermal transfer printing sheets of three colors of yellow, magenta and cyan, or of four colors of the three colors and black, by placing the three or four colors one over another on an image-receiving paper sheet.

In the heat sublimation transfer printing process, it is required that the sheet to which an image is to be transfer-printed has a dyable image-receiving surface. Therefore, it was almost impossible to transfer-print an image on a sheet that does not have an image-receiving layer thereon. To solve this problem, a heat sublimation transfer method was proposed in Japanese Patent Laid-Open Publication No. 62-238791 published Oct. 19, 1987. According to this method, an image can be transfer-printed to an ordinary paper sheet without using a special sheet preliminarily provided with an image-receiving layer. This method comprises a step of forming an image in an image-receiving layer provided releasably on a substrate sheet of an intermediate transfer recording medium by using a thermal transfer sheet having coloring material layers thereon together with a thermal head, and a step of transferring the image-receiving layer having the image therein to the surface of a printing sheet which is an ordinary paper sheet. This known method therefore consists of an image forming step to the image receiving layer of the intermediate transfer recording medium and an image transfer step from the intermediate transfer recording medium to the ordinary paper sheet. These two steps can be carried out either in a line or in separate lines or off line.

When the above method is carried out in a line as disclosed in Japanese Patent Laid-Open Publication No. 61-106,273, drive systems for the two separate steps are made common to simplify the mechanism and synchronized to shorten the time of the operation. However, because there is a distance between an image forming section in which the coloring material is transferred and an image transfer section in which the image-receiving layer is transferred, it is difficult to exactly position an image forming area of the intermediate transfer recording medium in the image transfer section after the medium is fed from the image forming section so that the image transfer area tends to shift relative to the image forming area.

There is a further problem that the intermediate transfer recording medium cannot be fully utilized from the rear edge of an image forming area to the front edge of the succeeding image forming area so that there is a waste of the non-utilized portions of the transfer recording medium with resultant increase of the operational cost.

Moreover, in the case where the method is carried out off the line, it is impossible to determine the position of the image forming area when the image-receiving layer is to be transferred to an ordinary paper sheet, so that selective transfer of an image forming area having an image formed therein onto the printing sheet is difficult to perform.

Further, in the case of transfer-printing of color images, after the image forming of one color on the image-receiving layer, the image forming of the next color must be carried out to produce a superposed three- or four-color image in the image-receiving layer. In order to perform this superposed image forming, the intermediate transfer recording medium must be fed back to an initial position at which the image forming of the preceding color was started, for the image forming of the next color. This feeding back of the recording medium is difficult to perform with exact positioning. More specifically, it is difficult to feed back each image forming area for the next color printing to the exact position at which the forward edge of the image forming area is in exact registration with the forward edge position taken for the preceeding color image forming.

Further, when the known heat sublimation transfer method is carried out in a line as mentioned before, the intermediate transfer recording medium is fed concurrently in both the image forming section and the image transfer section, and this causes the following problems.

1. The pass length of the intermediate transfer recording medium is large so that it is difficult to control the tension appropriately with the result that non-uniformity of feed and wrinkling of the recording medium tend to occur. A thin film substrate is used for the recording medium. Therefore, if there is too large a tension, the film substrate will be stretched, causing inexact positioning, while if there is too small a tension, the film substrate will be fed obliquely and wrinkled.

2. If there occurs up and down movement of a thermal head or movement of a heating roll toward and away from a platen roll in one section of the printing apparatus during the transfer printing operation, the pass length of the intermediate transfer recording medium will change, causing variation in tension, and this influences the other section of the printing apparatus, causing non-uniform feeding and inexact positioning of the recording medium.

3. In order to perform at the same time the image forming to the recording medium and the image transfer to the printing sheet, the feed rate or speed of the recording medium must be made the same in both the image forming section and the image transfer section. This is rather difficult.

4. When it is required to change the feed rate of the recording medium in both the image forming section and the image transfer section, the image forming operation and the image transfer operation cannot be effected concurrently so that the operational efficiency will drop.

In order to transfer the image-receiving layer having the dye image formed thereon from the intermediate transfer recording medium to the printing sheet, a thermal head, a hot stamper, a heat roller or the like is ordinarily used as a heating means in the prior art.

In a method in which a thermal head is used to transfer an image-receiving layer to a printing sheet, pulses of repetitive heating and cooling are given to the thermal head. In addition, the thermal head is such that a large number of heating resistors are arranged on every picture element in the main-scanning direction, so that non-heating portions are produced between electrodes provided in the main-scanning direction, and it is thus difficult to uniformly heat the image-receiving layer. For these reasons, the image-receiving layer tends to have a crack after it is transferred to the printing sheet. When the image-receiving layer has a crack, oxygen can easily pass through it. Such a crack is therefore disadvantageous from the viewpoint of weather resistance, and becomes the cause of the deterioration of the durability of the image-receiving layer. In a method in which a hot stamper or a heat roller is used to transfer an image-receiving layer to a printing sheet, it is necessary, in order to attain quick printing response, to heat (preheat) the hot stamper or the heat roller even when printing is not conducted because the hot stamper or the heat roller takes time to reach a predetermined temperature. Therefore, not only the power consumption is large, but also there is the problem of safety. In addition, since the parts of the hot stamper or the heat roller are large, it is inevitable that the entire device becomes large.

Furthermore, it is difficult to control the energy which is applied to the image-receiving layer when it is transferred to the printing sheet. This is because when heat is excessively applied to the image-receiving layer, the surface thereof becomes rough, and when the application of heat is insufficient, the image-receiving layer cannot be fully adhered to the printing sheet.

SUMMARY OF THE INVENTION

It is a first object of the present invention to provide a method and apparatus for thermal transfer recording or printing, which enables the transfer recording to be carried out with exact positioning and registration and which enables reduction of non-used portions of the intermediate transfer recording medium.

It is a second object of the present invention to provide an apparatus for thermal transfer printing, which enables independent operation of the image forming section and the image transfer section without mutual influence.

A third object of the present invention is to provide a method and apparatus for thermal transfer printing which can attain uniform heating of an intermediate transfer recording medium and in which preheating is not required for a heating device because of its quick response to heat.

According to the present invention, the first object is attained by a method of thermal transfer printing, comprising the steps of: providing an intermediate transfer recording medium made up of a substrate sheet and an image-receiving layer releasably attached to one surface of the substrate sheet, said image-receiving layer having an image forming area; providing a thermal transfer sheet having a coloring material layer including a coloring material on one surface thereof; passing the transfer recording medium and the thermal transfer sheet between heating means and platen means under pressure with the image-receiving layer facing the coloring material layer; operating the heating means in accordance with image information to heat the coloring material layer to cause the coloring material to migrate from the coloring material layer to the image forming area of the image-receiving layer, thereby forming an image in the image forming area, the above steps constituting an image forming step; superposing a printing sheet on the image-receiving layer, having the image formed therein, of the intermediate transfer recording medium; applying heat and/or pressure to the printing sheet and the transfer recording medium to transfer-print the image in the image-receiving layer onto the printing sheet, the superposing and applying steps constituting an image transfer step and determining position of the image forming area in the image forming step by detecting a detection mark provided on the intermediate transfer recording medium.

The above step of determining position of the image forming area can be carried out in the image transfer step as well by detecting the detection mark.

The first object is also attained by an apparatus for thermal transfer printing, comprising: means for feeding a thermal transfer sheet having a coloring material layer including a coloring material on one surface thereof; means for feeding an intermediate transfer recording medium made up of a substrate sheet and an image-receiving layer releasably attached to one surface of the substrate sheet in such a manner that the transfer recording medium will be conveyed together with the thermal transfer sheet along a path with the image-receiving layer facing the coloring material layer; heating means provided alongside the path to heat the coloring material layer in accordance with image information to cause the coloring material to migrate from the coloring material layer to an image forming area of the image-receiving layer, thereby forming an image in the image forming area; platen means for pressing the thermal transfer sheet and the intermediate transfer recording medium against the heating means; and detection means for detecting a detection mark provided on the intermediate transfer recording medium and for positioning the image forming area of the transfer recording medium relative to the heating means when the image is formed in the image forming area.

A similar detection means may be provided for detecting the detection mark for positioning the image forming area relative to heating means for heating the intermediate transfer recording medium to transfer the image forming area to a printing sheet.

The second object of the invention is attained by an apparatus for transfer printing of the above stated type, having buffer means provided between the image forming section and the image transfer section in association with the intermediate transfer recording medium for adjusting the length of the medium between the two sections.

The third object of the invention is attained by a method and apparatus of the above stated type, using heating means in the form of a line heater for transferring a formed image in the intermediate transfer recording medium onto a printing sheet.

Preferred embodiments of the present invention will be understood from the following detailed description with reference to the accompanying drawings.

DESCRIPTION OF THE PREFERRED EMBODIMENTS

Figure 1:
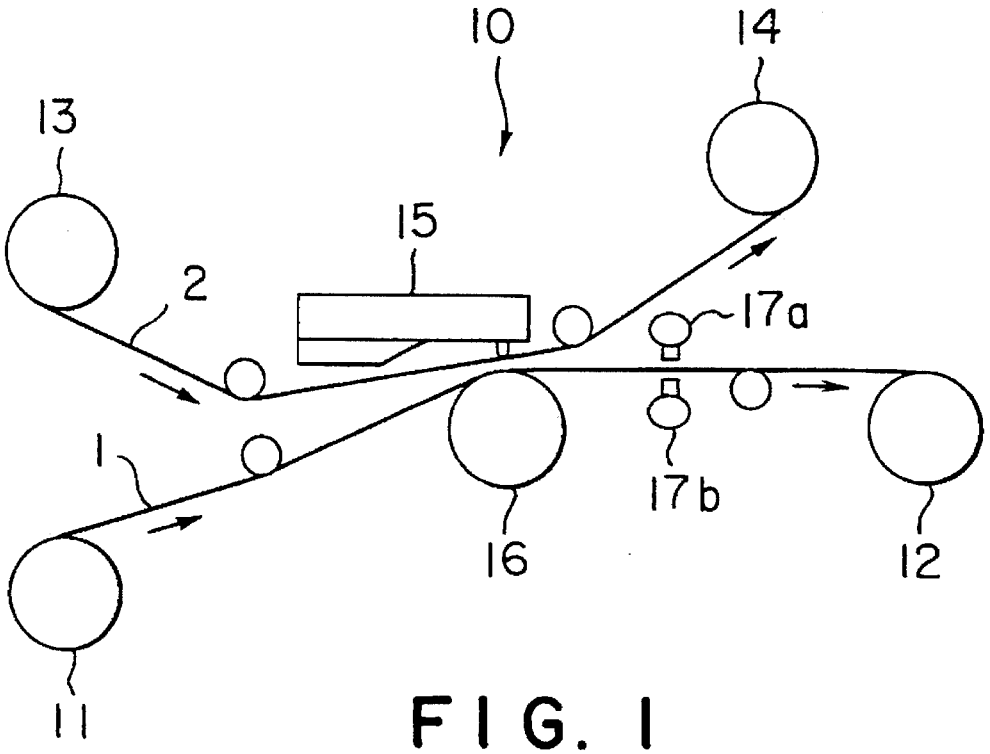
FIG. 1 is a schematic view showing an image forming section of an apparatus for thermal transfer printing according to the present invention.
Figure 2:
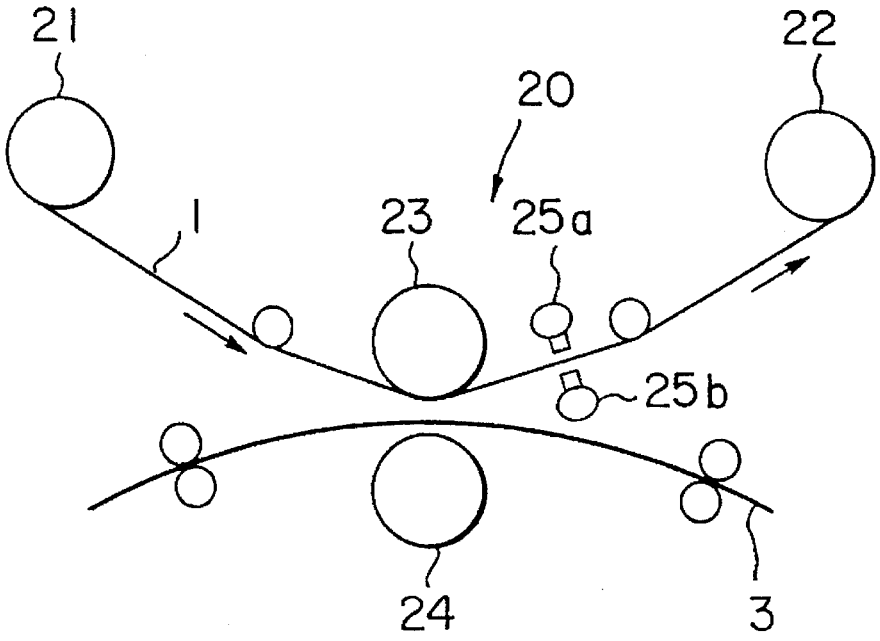
FIG. 2 is a schematic view showing an image transfer section of the apparatus for thermal transfer printing.

Referring first to FIGS. 1 and 2, an image recording method and apparatus will be described. The image recording method comprises an image forming step shown in FIG. 1 and an image transfer printing step shown in FIG. 2. The step of FIG. 1 uses an intermediate transfer recording medium 1 in the form of a strip, and a thermal transfer printing sheet 2 also in the form of a strip. The step of FIG. 2 uses the intermediate transfer recording sheet 1 and a printing sheet 3 to which an image is finally applied.

The intermediate transfer recording medium 1 comprises essentially a substrate sheet and an image-receiving layer releasably applied to one surface of the substrate sheet. For improving slidability of the intermediate transfer recording medium 1 relative to a heating means such as a thermal head, a back layer may be applied to the surface of the substrate sheet opposite to the one surface on which the image receiving layer is provided. Further, in order to control releasing of the image-receiving layer from the substrate sheet, a releasing layer may be provided between the substrate sheet and the image-receiving layer.

In order to protect the image-receiving layer transferred to the printing sheet 3 from the intermediate transfer recording medium 1 to produce an image on the sheet 3, an image protection layer may be provided between the substrate sheet and the image-receiving layer of the medium 1. This image protection sheet is transferred to the surface of the printing sheet 3 together with the image-receiving layer and improves the weather resistance property and resistance to finger marks and chemicals of the printed image.

Figure 3:
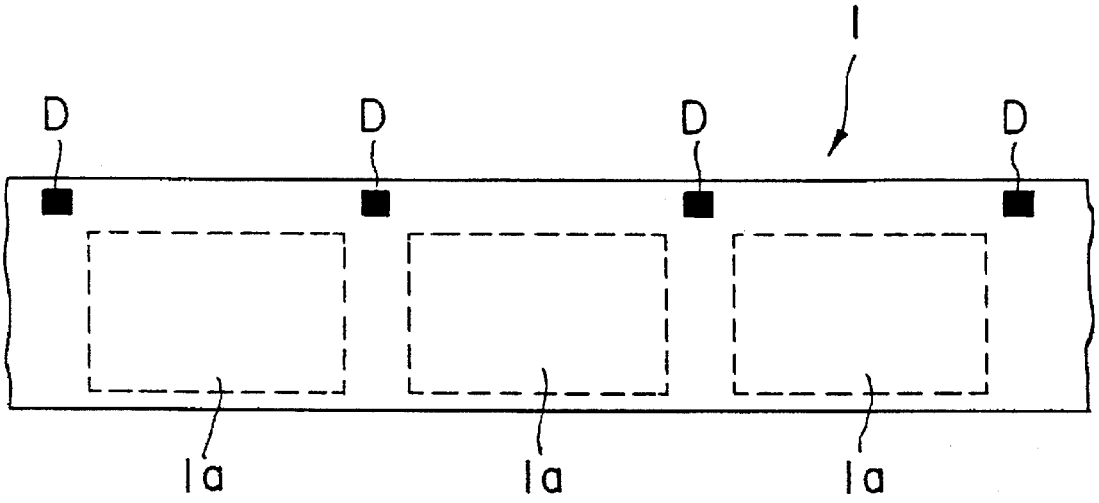
FIG. 3 is a plan view of an example of an intermediate transfer recording medium.

As shown in FIG. 3, the intermediate transfer recording medium 1 has the image-receiving layer all over a surface thereof and detection marks D serving as means for determining image forming areas 1*a*. The detection marks D are produced, for example, by applying a black ink containing carbon black particles. In this embodiment, the thermal transfer printing sheet 2 is provided thereon with coloring material or dye layers of yellow, magenta and cyan arranged in series along the length of the sheet 2, as is known in the art. The detection marks D are provided at predetermined positions with respect to the respective image forming areas 1*a*.

The step of FIG. 1 is carried out in an image forming section 10. The intermediate transfer recording medium 1 is paid out from a supply roll 11 and taken up by a takeup roll 12, while the thermal transfer printing sheet 2 is paid out from a supply roll 13 and taken up by a takeup roll 12. While being fed from the supply rolls to the takeup rolls, the recording medium 1 and the transfer printing sheet 2 are superposed and passed through a gap between a thermal head 15 and a platen roller 16, with the image-receiving layer of the recording medium 1 facing a coloring material (dye) layer of the transfer printing sheet 2. A light emitting element 17*a* and a light receiving element 17*b* are disposed on the opposite sides of the pass of the intermediate transfer recording medium 1. A light emitting diode for emitting near infrared light may be used as the light emitting element 17*a*, while a photodiode capable of sensing the near infrared light may be used as the light receiving element 17*b*.

When the image forming step is started, longitudinal positional setting of the thermal transfer printing sheet 2 is so performed that a section of the yellow dye layer on the sheet 2 will coincide with the heating area of the thermal head 15. Then, the intermediate transfer recording medium 1 is fed forward toward the takeup roll 12 until one of the detection marks D on the medium 1 will be positioned between the light emitting and light receiving elements 17*a* and 17*b* so that the detection mark is detected by these elements. The feeding of the medium 1 is stopped at this position.

Then, the thermal head 15 is moved against the platen roller 16 by means of a motive means mounting the head 15, whereby the transfer recording medium 1 and the transfer printing sheet 2 are nipped between the platen roller 16 and the head 15. Thereafter, the platen roller 16 is driven in rotation to feed the medium 1 and the sheet 2 together at a predetermined speed, and an electric signal corresponding to image data to be printed is supplied to the thermal head 15 from a thermal head drive circuit. Heat producing resistance elements of the thermal head 15 are thereby heated, and a yellow image is produced in the image-receiving layer in the image forming area 1*a* of the medium 1.

Thereafter, the thermal head 15 is moved away from the platen roller 16 by means of the motive means, and then the succeeding section of magenta dye layer of the sheet 2 is positioned to coincide with the thermal head 15 by feeding the sheet forward. Next, the intermediate transfer recording medium 1 is fed backward, by backwardly rotating the supply roll 11, to such a position in which the image forming area 1*a* having the yellow image already formed therein coincides with the heating area of the thermal head 15. This backward feed of the medium 1 is carried out on the basis of the detection mark D. The same operation is repetitively carried out for the magenta color and cyan color. The intermediate transfer recording medium 1 is thus given respective color images in the successive image forming areas 1*a* and is wound up on the takeup roll 12, which is then conveyed to the next image transfer section 20 shown in FIG. 2.

When a magenta color image and a cyan color image are formed in the image forming area 1*a*, in which a yellow color image has already been formed, the backward feed of the medium 1 may be carried out not by feeding back the medium 1 on the basis of the detection mark D but by feeding back the medium 1 by a length equivalent to the amount of the forward feed of the medium for the formation of the yellow color image. This feeding back is carried out by controlling the drive means for the feed of the medium 1.

In the image transfer section 20 shown in FIG. 2, the intermediate transfer recording medium 1 having yellow, magenta and cyan color images formed thereon is paid out from a supply roll 21 and taken up by a takeup roll 22. The printing sheet 3 is passed in a confronting relation with the medium 1 between a heating roller 23 and a platen roller 24 with the image forming areas 1*a* of the medium 1 facing the printing sheet 3. A light emitting element 25*a* such as a diode emitting near infrared light is disposed at one side of the pass of the medium 1, and a light receiving element 25*b* such as a photodiode sensitive to near infrared light is disposed at the other side of the pass of the medium 1. In the example of FIG. 3, the detection marks D are positioned between adjacent image forming areas 1*a* and along one longitudinal edge of the medium 1.

When the image transfer step is started, the heating roller 23 is first heated at a predetermined temperature. Then, the heating roller 23 and the platen roller 24 are rotated in directions corresponding to the feeding direction of the intermediate transfer recording medium 1. Together with the rotation of these rollers 23 and 24, the medium 1 is conveyed toward the takeup roll 22. When the forward edge of an image forming area 1*a* reaches the position of the nip of these two rollers 23 and 24, this is detected on the basis of the relevant detection mark D, whereupon a detection signal is issued and causes a platen roller mounting device to move the platen roller 24 against the heating roller 23. As a result, the image is transfer printed on the printing sheet 3, that is, the image-receiving layer of the image forming area is transferred to the printing sheet 3.

Figure 4:
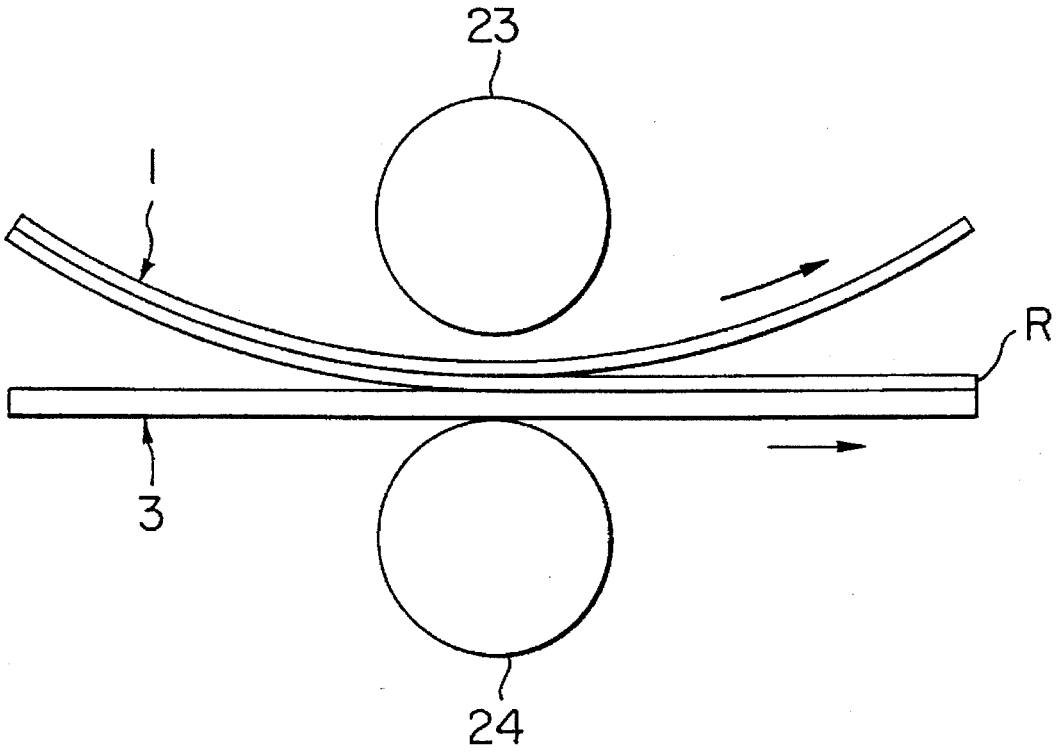
FIG. 4 is an enlarged view of a part of the image transfer section.

This image transfer printing operation is continued while feeding together the medium 1 and the printing sheet 3. When the rear edge of the image forming area reaches the position of nip between the two rollers 23 and 24, the platen roller 24 is caused to move away from the heating roller 23. Thereafter, the printing sheet 3 bearing a transfer printed image thereon is released from the medium 1 as indicated in FIG. 4 and the sheet 3 is fed out of the printer. It is to be noted that the image receiving layer R which was initially on the medium 1 is transferred to the printing sheet 3 after passing through the nip of the opposite rollers 23 and 24.

Any of the substrate sheets which are used in the conventional heat transfer printing sheets can be used as it is as the substrate sheet of the medium 1, and there is no particular limitation on the material. Specific examples of a preferable substrate sheet include thin papers such as glassine paper, condenser paper and paraffin paper; stretched or non-stretched films of plastics, for instance, polyesters having high heat resistance such as polyethylene terephthalate, polyethylene naphthalate, polybutylene terephthalate, polyphenylene sulfide, polyether ketone and polyether sulfone, polypropylene, polycarbonate, cellulose acetate, polyethylene derivatives, polyvinyl chloride, polyvinylidene chloride, polystyrene, polyamide, polyimide, polymethylpentene and ionomers; and laminates thereof. The thickness of the substrate sheet can be properly selected so as to make the strength and heat resistance of the substrate sheet proper. In general, however, a substrate sheet having a thickness of approximately 1 to 100 μm is preferably used.

The image-receiving layer comprises at least a binder resin, and various additives such as a releasing agent may be incorporated into to the image-receiving layer, if necessary. It is preferable to use, as the binder resin, a resin which can be readily dyed with a sublimable dye. Any of the following resins can be used as the binder resin: polyolefin resins such as polypropylene, halogenated resins such as polyvinyl chloride and polyvinylidene chloride, vinyl resins such as polyvinyl acetate polyacrylate, polyester resins such as polyethylene terephthalate and polybutylene terephthalate, polystyrene resins, polyamide resins, copolymers of an olefin such as ethylene or propylene and other vinyl monomer, ionomers, and cellulose derivatives. Of these resins, vinyl resins and polyester resins are preferably used.

In the case where the image-receiving layer is transferred to an adhesive layer provided on an image-receiving material, it is not always necessary to impart thermal adhesiveness to the image-receiving layer itself. Therefore, a resin which is hardly softened by heat can also be used as the resin for forming the image-receiving layer.

In order to prevent the thermal fusion between the image-receiving layer and a thermal transfer printing sheet, it is preferable to incorporate a releasing agent into the above-described resins. Silicone oil, a phosphoric ester surface active agent, a fluorine-containing compound or the like can be used as the releasing agent. Of these, silicone oil is preferably used. The amount of the releasing agent incorporated is preferably from 0.2 to 30 parts by weight for 100 parts by weight of the binder resin by which the image-receiving layer is formed. The image-receiving layer can be formed on the above-described substrate sheet in such a manner that an ink obtained by dissolving or dispersing the above-described resin together with needed additives such as a releasing agent in a medium such as water or an organic solvent is coated onto the surface of the substrate sheet by a conventional method such as the gravure printing method, the screen printing method, or the gravure-reverse roll coating method using a gravure. It is preferable to coat the ink in such an amount that the thickness of the apply layer after dried will be 0.1 to 10 μm.

The releasing layer comprises a binder resin and a material having release properties. Any of the following resins can be used as the binder resin: thermoplastic resins, for example, acrylic resins such as polymethyl methacrylate, polyethyl methacrylate and polybutyl acrylate, vinyl resins such as polyvinyl acetate, a vinyl chloride/vinyl acetate copolymer, polyvinyl alcohol and polyvinyl butyral, and cellulose derivatives such as ethyl cellulose, nitrocellulose and cellulose acetate; and thermosetting resins such as unsaturated polyester resins, polyester resins, polyurethane resins and aminoalkyd resins. Waxes, silicone waxes, silicone resins, melamine resins, fluororesins, fine particles of talc and silica, and lubricants such as surface active agents and metallic soaps can be used as the materials having release properties. The releasing layer can be formed in the same manner as in the formation of the image-receiving layer, and the thickness thereof is preferably from 0.1 to 5 μm.

An image-protective layer comprises at least a binder resin. To form the image-protective layer, it is necessary to select such a resin composition that can form a layer which has the properties of being properly released from the substrate sheet 2*a*, and which shows desired physical properties as the protective layer of the image-receiving layer after it is transferred to an image-receiving material together with the image-receiving layer. In general, the image-protective layer can be formed by using any of the following resins: thermoplastic resins, for instance, cellulose derivatives such as ethyl cellulose, nitrocellulose and cellulose acetate, acrylic resins such as polymethyl methacrylate, polyethyl methacrylate and polybutyl acrylate, and vinyl polymers such as polyvinyl chloride, a vinyl chloride/vinyl acetate copolymer and polyvinyl butyral; and thermosetting resins such as unsaturated polyester resins, polyurethane resins and aminoalkyd resins. In the case where an image-receiving material on which an image is formed is particularly required to have resistance to abrasion, chemicals and stain, an ionizing-radiation-hardening resin may also be used as the resin for forming the image-protective layer. Further, to the above-enumerated resins may be added a lubricant in order to improve the friction resistance of the image-printed matter, a surface active agent in order to protect the image-printed matter from staining, and an ultraviolet-absorbing agent or an antioxidant in order to improve the weather resistance of the image-printed matter. The image-protective layer can be formed in the same manner as in the formation of the image-receiving layer, and the thickness thereof is preferably from 0.1 to 10 μm.

In order to prevent the thermal fusion between the intermediate transfer recording medium and the heating device such as a thermal head or a line heater, and to smoothly feed the intermediate transfer recording medium at the time when a coloring material is transferred from the thermal transfer printing sheet a printing sheet recording medium, and at the time when the image-receiving layer is transferred to a printing sheet, a back layer can be provided on the surface of the substrate sheet which surface is brought into contact with the heating device and opposite to the surface on which the image-receiving layer is provided. Examples of a resin which can be used for forming the back layer include natural or synthetic resins, for example, cellulose resins such as ethyl cellulose, hydroxy cellulose, hydroxypropyl cellulose, methyl cellulose, cellulose acetate, cellulose acetate butyrate and nitrocellulose, vinyl resins such as polyvinyl alcohol, polyvinyl acetate, polyvinyl butyral, polyvinyl acetal and polyvinyl pyrrolidone, acrylic resins such as polymethyl methacrylate, polyethyl acrylate, polyacrylamide and an acrylonitrile-styrene copolymer, polyamide resins, polyvinyltoluene resins, coumarone-indene resins, polyester resins, polyurethane resins, and silicone- or fluorine-modified urethanes. The above resins can be used either singly or in combination. In order to further enhance the heat resistance of the back layer, a crosslinked resin layer which can be obtained by the combination use of a resin having a reactive group such as a hydroxyl group, selected from the above resins and a crosslinking agent such as polyisocyanate is preferably used as the back layer. Further, in order to make the intermediate transfer recording medium smoothly move on a thermal head, a solid or liquid releasing agent or lubricant may be incorporated into the back layer so as to impart thereto heat-resistant slipperiness. Examples of the releasing agent or lubricant include waxes of various types such as polyethylene wax and paraffin wax, higher fatty alcohols, organopolysiloxane, anionic surface active agents, cationic surface active agents, ampholytic surface active agents, nonionic surface active agents, fluorine-containing surface active agents, organic carboxylic acids and derivatives thereof, fluororesins, silicone resins, and fine particles of inorganic compounds such as talc and silica. The amount of the releasing agent or lubricant incorporated into the back layer 15 is 5 to 50% by weight, preferably about 10 to 30% by weight.

The thermal transfer printing sheet used in the present invention is one in which a heat-resistant slippery layer is provided on one surface of a substrate sheet, and a thermally-transferable coloring material layer is provided on the other surface of the substrate sheet. In the heat sublimation transfer printing process, a known dye heat transfer printing sheet in which a dye layer comprising a sublimable dye and a binder resin is used as the coloring material layer. In the hot-melt transfer printing process, a known thermoplastic-resin-hot-melt-ink transfer printing sheet in which a hot-melt transfer layer comprising a coloring material such as a pigment or a dye and a wax or a thermoplastic resin is used as the coloring material layer. In the dye heat transfer printing sheet, a dye which is sublimed and transferred by heat is the coloring material which forms an image. In the case of the hot-melt ink transfer printing sheet, an ink which is melt and transferred is the coloring material.

The image finally obtained by the method of the present invention and the image formed on the image-receiving layer of the intermediate transfer recording medium are in the relation of an object to its reflected image. It is therefore necessary to form images of letters or symbols reversely on the image-receiving layer.

There is no particular limitation on the image-receiving material which can be used in the present invention. Any of the following materials can be used as the image-receiving material: natural fiber paper, coated paper, tracing paper, plastic films which are not deformed by heat applied when an image is transferred thereto, glass, metals, ceramics, woods, colors and the like. Moreover, the shape and use of the image-receiving material are not limited, and those image-receiving materials which are used for the following purposes can be used: stock certificates, bonds, certificates, bankbooks, railroad tickets, passenger tickets, revenue stamps, postage stamps, admission tickets and other tickets, cards such as cash cards, credit cards, prepaid cards, member's cards, greeting cards, post cards, name cards, driving licenses, IC cards and optical cards, cases such as cartons and containers, bags, documents, envelopes, tags, OHP sheets, slide films, bookmarkers, calendars, posters, pamphlets, menus, passports, POP supplies, coasters, displays, name plates, key boards, cosmetics, personal ornaments such as wrist watches and lighters, stationeries, writing materials, construction materials, panels, emblems, keys, clothes, shoes, electric apparatus such as radios, TV sets, electric calculators and OA apparatus, sample books, albums, printing paper for computer graphic images, and printing paper for medical images.

The method described with reference to FIGS. 1 to 4 is an off-line process. An in-line process including an image forming step and an image transfer step will be described below with reference to FIG. 5, which shows an embodiment of an image recording apparatus in which an image forming section and an image transfer section are incorporated in series.

Figure 5:
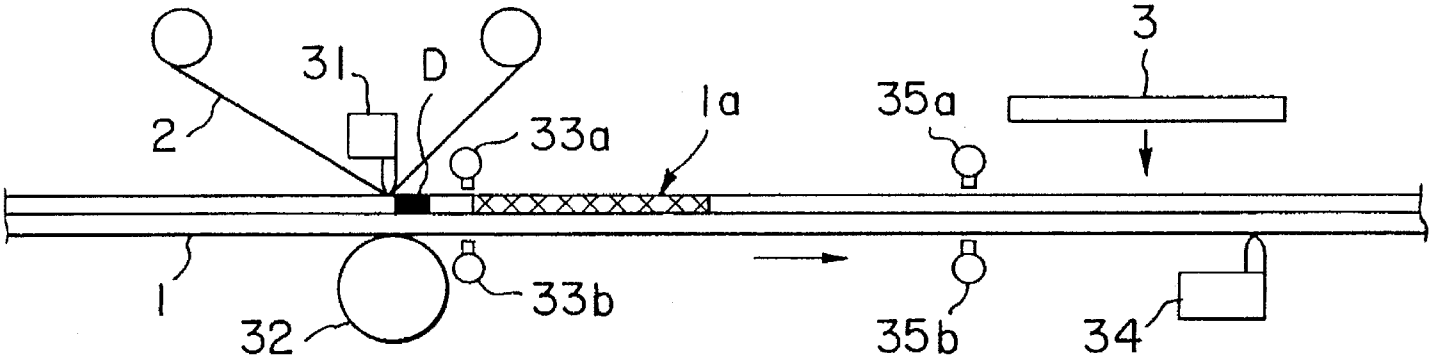
FIG. 5 is a view of an apparatus for thermal transfer printing in which an image forming section and an image transfer section are arranged continuously in a line, the apparatus being shown in a state wherein an image forming step has been completed.

In FIG. 5, reference numeral 31 designates a thermal head as heating means provided in the image forming section. The thermal head 31 is provided in confrontation with a platen roller 32, and between these members are passed an intermediate transfer recording medium 1 and a thermal transfer sheet 2 in mutually superposed manner in which the dye layer of the sheet 2 faces the image receiving layer of the medium 1. When the thermal head 31 is urged against the medium 1 via the thermal transfer sheet 2 and when the medium 1 and the sheet 2 are conveyed forward at a predetermined speed while the thermal head 31 is operated, the image receiving layer on the medium 1 receives an image from the dye layer of the sheet 2.

FIG. 5 further shows a light emitting element 33*a* and a light receiving element 33*b*, which are similar to those provided in the preceding embodiment and constitute means for detecting the detection marks. Reference numeral 34 shows a heating device provided in the image transfer section. This heating device may be constituted by a thermal head, a heating roll, a line heater, a hot stamper or the like.

When the intermediate transfer recording medium 1 is superposed on a printing sheet 3 with the image forming area 1*a* having an image therein facing the printing sheet 3 and when the heating device 34 is pressed against the backside of the medium 1, the image receiving layer having the image applied thereto is transferred to the printing sheet 3 from the substrate of the medium 1. In a case where the printing sheet 3 is thin, the heating device 34 may be urged against the backside of the printing sheet 3. A light emitting element 35*a* and a light receiving element 35*b* are provided to constitute means for detecting the detection marks. In this embodiment, the intermediate transfer recording medium 1 is fed continuously from the image forming section to the image transfer section, and the process is carried out in a line.

There are two types of thermal transfer printing sheet 2, one being for monocolor printing and the other for color printing. A thermal transfer printing sheet for color printing has three color dye areas of cyan, magenta and yellow and sometimes four color areas additionally including black areas. The present invention can use any of the above types of the sheet.

With reference to FIGS. 5 to 8, an example of monocolor transfer printing will be described below.

Figure 6:
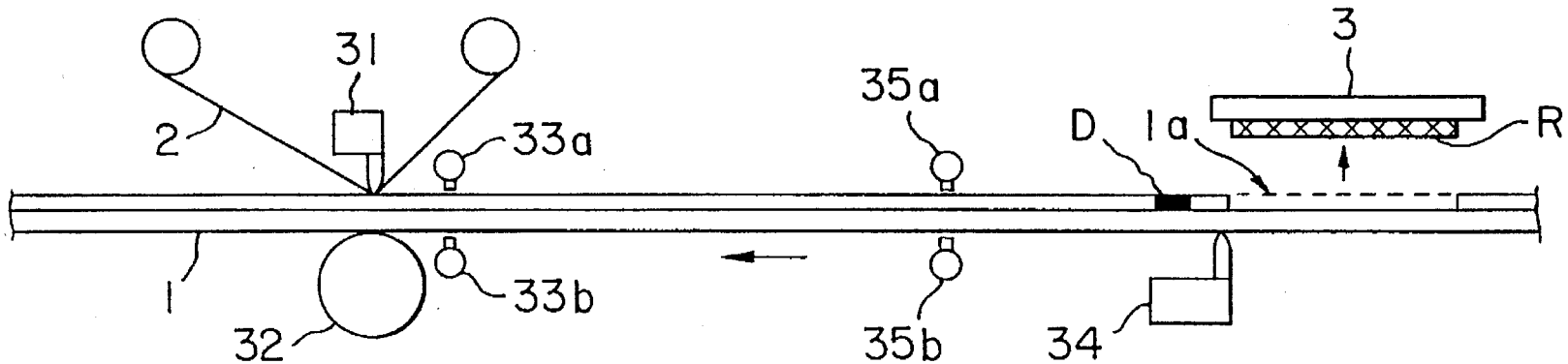
FIG. 6 is a view of the apparatus of FIG. 5, shown in a state wherein an image transfer step has been completed.

FIG. 5 shows a state wherein an image has been formed in the image-receiving layer on the intermediate transfer recording medium 1 and wherein a detection mark D has been applied to the medium 1 at a specific position relative to the image forming area 1*a* by means of a sublimation transfer printing method. The medium 1 is fed to the right as viewed in FIG. 5 until the image forming area 1*a* coincides with the printing sheet 3, whereupon the image-receiving layer of the area 1*a* having an image formed therein is transferred to the printing sheet 3. FIG. 6 shows a state in which an image-receiving layer R having an image therein has been transferred to the printing sheet 3.

When a next image formation is carried out to the medium 1 in the state of FIG. 6, there will remain a non-used region of the medium 1 between the detection mark D and the thermal head 31. The embodiment shown can prevent such a non-used region from remaining.

Figure 7:
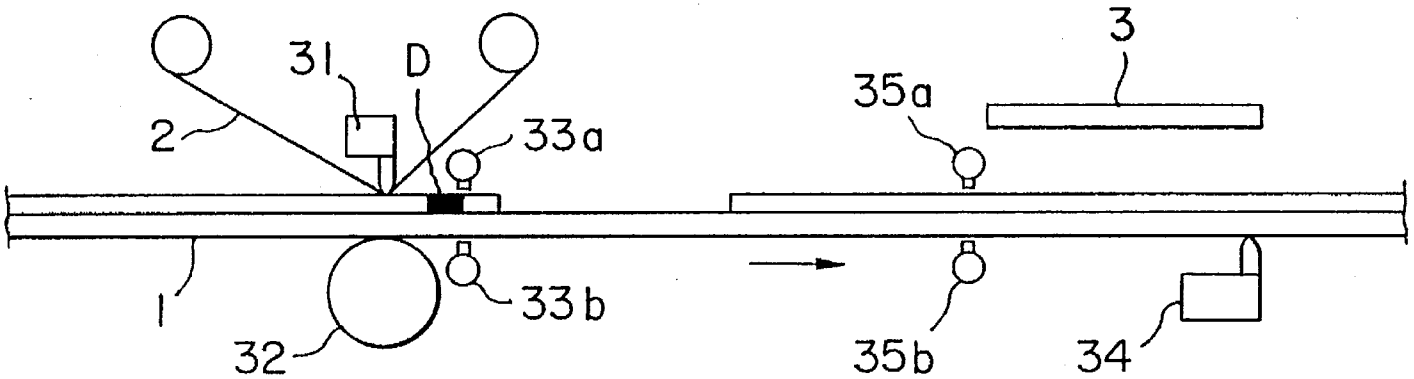
FIG. 7 is a view of the apparatus of FIG. 5, shown in a state wherein a next image forming step is about to be started after feeding back the intermediate transfer recording medium.
Figure 8:
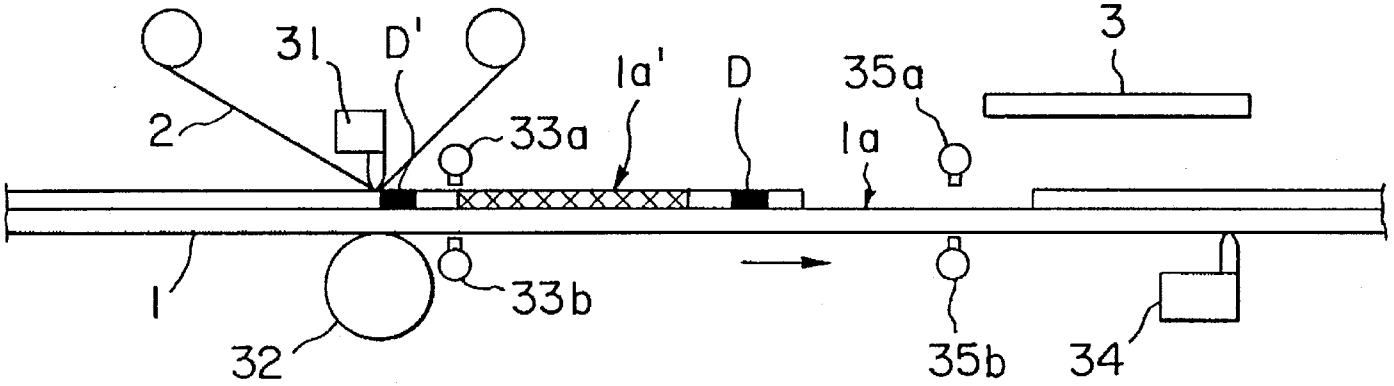
FIG. 8 is a view of the apparatus of FIG. 5, showing the next image forming step and shown in a state wherein a detection has just been applied in the neighborhood of an image thus formed.

According to the embodiment, the medium 1 is fed back to the left as viewed from the position of FIG. 6 to the position of FIG. 7 in which the detection mark D is detected by the detection device 33*a*, 33*b*. Thereafter, the next image formation is performed to the image forming area. As a result of this next image formation, a next image forming area 1*a*' and a next detection mark D' are applied to the medium 1 adjacent to the image forming area 1*a* and the detection mark D, as indicated in FIG. 8. It will be understood that any non-used region of the medium 1 is not produced. If the distance between the thermal head 31 of the image forming section and the heating device 34 of the image transfer section is determined appropriately, both the image forming step and the image transfer step can be performed concurrently. In this case, the detecting device 35*a*, 35*b* may be eliminated.

Figure 9:
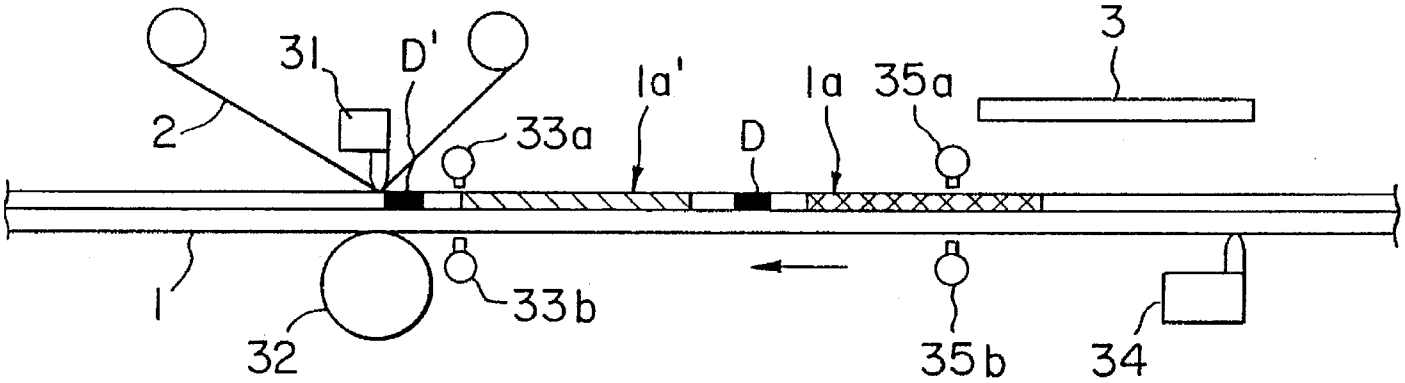
FIG. 9 is a view of the apparatus of FIG. 5 in a state wherein a first color image has just been formed in the case of color image printing and a detection mark has just been formed in the neighborhood of the first color image thus formed.
Figure 10:
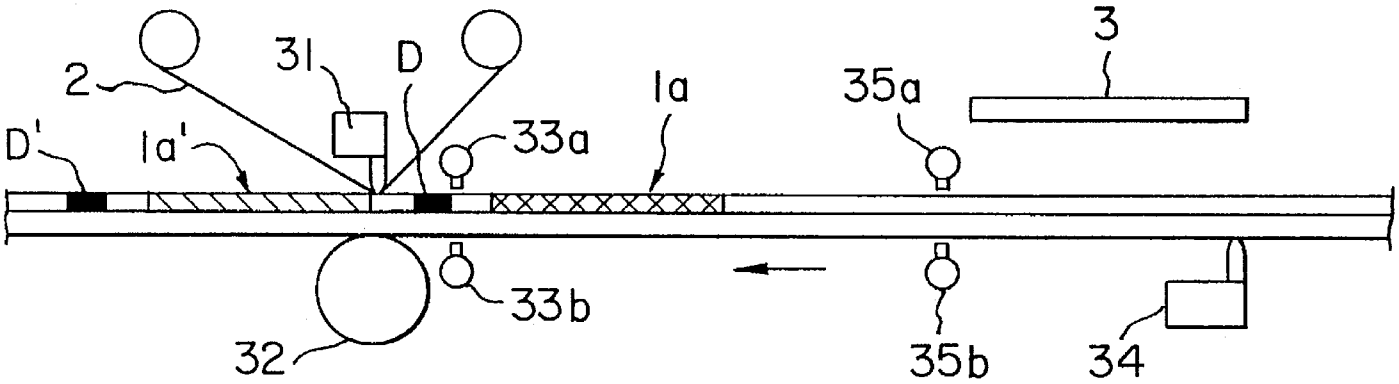
FIG. 10 is a view of the apparatus in a state wherein a second color image forming is about to be carried out.

FIGS. 9 and 10 illustrate how a color image is printed on a printing sheet by using the above stated image recording apparatus.

FIG. 9 shows a state in which a three-color image has been formed in a forward image forming area 1*a* of the medium 1, and a forward detection mark D has been printed at a predetermined position relative to the area 1*a*. FIG. 9 further shows a state in which a first color image has been formed in a next image forming area 1*a*' and a next detection mark D' has been printed at a predetermined position relative to the area 1*a*'. The medium 1 is fed back to the left as viewed in FIG. 9 until the detection mark D is detected by the detection device 33*a*, 33*b* as shown in FIG. 10.

Thereafter, a second color image formation is performed in the next area 1*a*' in the state of FIG. 10. A third color image formation is also performed in the area 1*a*' in the same state of FIG. 10. By doing as above, image forming operation can be carried out efficiently in succession and the three-color image formation can be carried out with exact registration of the three color images. The next detection mark D' can be used again as a positioning means when a further succeeding image forming area is to be formed a next image. The image transfer step can be carried out appropriately, but both the image forming step and the image transfer step can be carried out concurrently if the distance between the thermal head 31 and the heating device 34 is selected appropriately. In this case, the detecting device 35*a*, 35*b* may be eliminated.

The detection marks used in the present invention may be applied to the intermediate transfer recording medium concurrently with the image formation in each image forming area of the image-receiving layer of the medium, as described hereinbefore. Alternatively, the detection marks may be provided preliminarily on the medium. The formation of the detection marks can be summarized as follows.

I. Concurrent formation of the detection marks with the image formation on the medium 1. The detection marks are produced, using the coloring material for the image formation (hot-melt ink, sublimable dye) in the case of optical detection of the marks.

2. An ink layer or local ink layers for forming the detection marks are preliminarily provided on the thermal transfer sheet, and these ink layers are transfer-printed on the intermediate transfer recording medium. The local ink layers may be arranged alternately with the coloring material layers with respect to the longitudinal direction of the thermal transfer sheet. Alternatively, the local ink layers may be provided along one edge of the thermal transfer sheet at positions corresponding to the respective coloring material layers. The ink layers may be provided in the shape of the detection marks, or the ink layer may be selectively transfer-printed at local portions to produce the detection marks. This method is suitable in the case of optical, magnetic or electrical detection.

3. The detection marks are produced by applying tapes to the intermediate transfer recording medium. This method can be used in the case of optical, magnetic, electric or physical detection. The physical detection makes use of protrusion of the applied tapes.

4. The detection marks are produced by forming recesses and/or protrusions. This method can be used for optical or physical detection.

Figure 11:
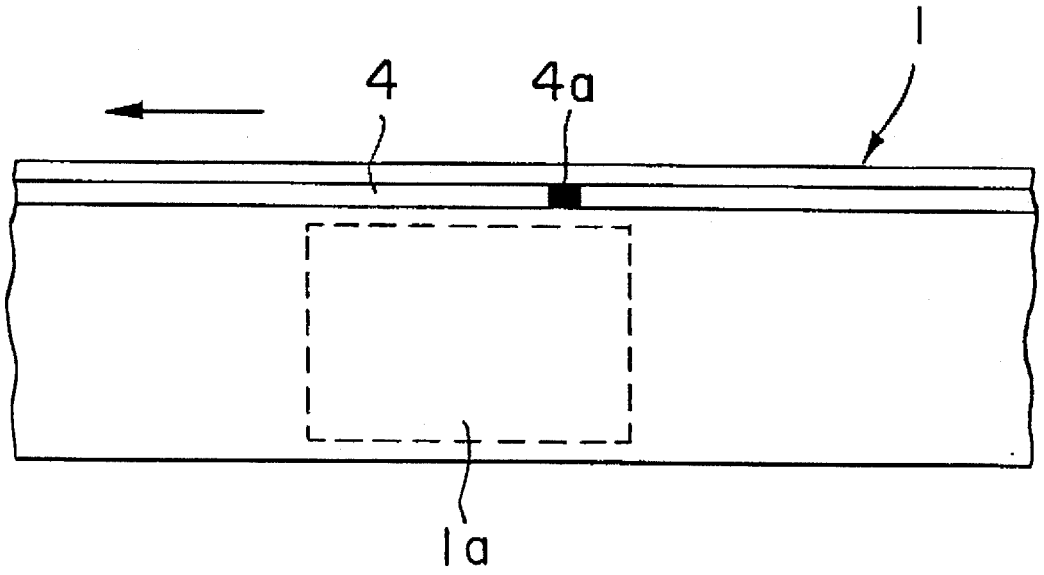
FIG. 11 is a plan view of an intermediate transfer recording medium having a color producing layer in which a detection mark is formed.

5. As shown in FIG. 11, a layer 4 of a heat-sensitive color producing material is applied in an area, excluding the image forming areas 1*a*, of the intermediate transfer recording medium 1 (for example, along one edge of the medium as shown). The layer 4 is selectively heated at local areas to produce colored areas 4*a* serving as detection marks. This method is suitable for optical detection.

Figure 12:
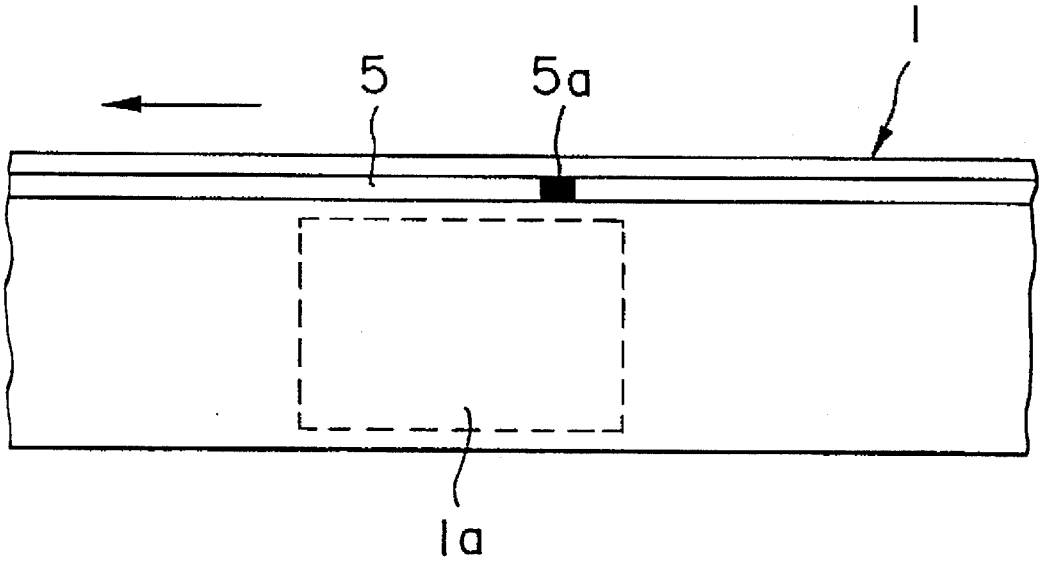
FIG. 12 is a plan view of an intermediate transfer recording medium having a magnetic stripe in which a detection mark is formed.

6. As shown in FIG. 12, a magnetic stripe 5 is provided in an area, excluding the image forming areas 1*a*, of the intermediate transfer recording medium 1 (for example, along one edge of the medium as shown), and magnetic information recording portions 5*a* are formed locally of the stripe 5 to provide the detection marks. The magnetic stripe 5 may be provided by transfer-printing when the image is formed on the medium 1, or the magnetic stripe 5 may be provided when the medium 1 is produced. This method is suitable for magnetic detection.

II. Preliminary provision of the detection marks on the intermediate transfer recording medium 1. The detection marks are applied by coating. This method is suitable for optical, magnetic or electrical detection.

2. The detection marks are produced by mechanically applying tapes. This method is suitable for optical, magnetic, electrical or physical detection.

3. The detection marks are produced by forming recesses or protrusions. This method is suitable for optical or physical (contact) detection.

4. As shown in FIG. 12, a magnetic stripe 5 having magnetic information recording portions 5*a* is preliminarily applied to an area excluding the image forming areas 1*a* of the medium 1 (for example, along one longitudinal edge of the medium). The stripe 5 is applied when the medium 1 is produced. This method is suitable for magnetic detection.

The optical, magnetic, electrical and physical detections mentioned above are carried out as follows.

1. Optical detection:

A light emitting element and a light receiving element are used in combination. The detection marks are detected on the basis of the difference of the quantity of transmitted light or reflected light between the detection marks and their surrounding areas. The combination of the light emitting and receiving elements is suitably selected in consideration of the spectral light emitting characteristics of the light emitting element and the spectral light receiving characteristics of the light receiving element. The wave length of the light usable may be in any one of the ultraviolet, visible and infrared light ranges.

2. Magnetic detection:

A magnetic head is used for the detection. The detection marks can be detected by the head depending upon the existence or non-existence of a magnetic layer or the shape of the magnetic marks. Alternatively, the detection can be made depending upon information recorded in the magnetic layer.

3. Electrical detection:

Electrodes are used for the detection. The detection marks are detected depending upon whether there is an electric conduction or not.

4. Physical detection:

Recesses or protrusions are used for the detection. These are detected by mechanical contact and so on.

Figure 13A:
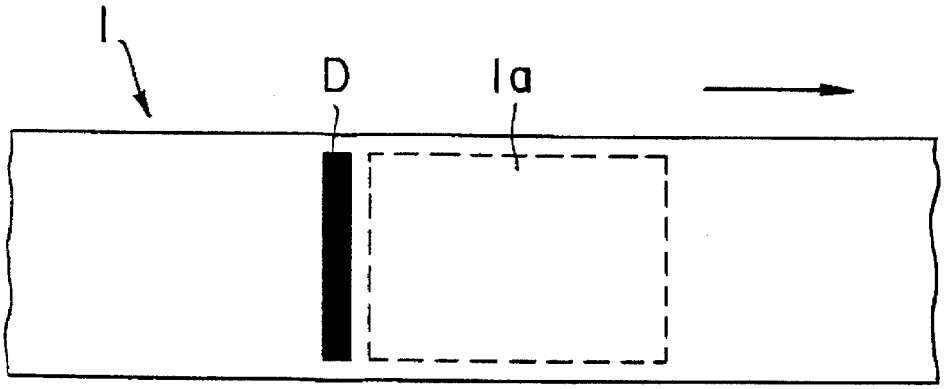
FIG. 13*a*, 13*b* and 13*c* show three different intermediate transfer recording media having different detection marks, respectively.
Figure 13B:
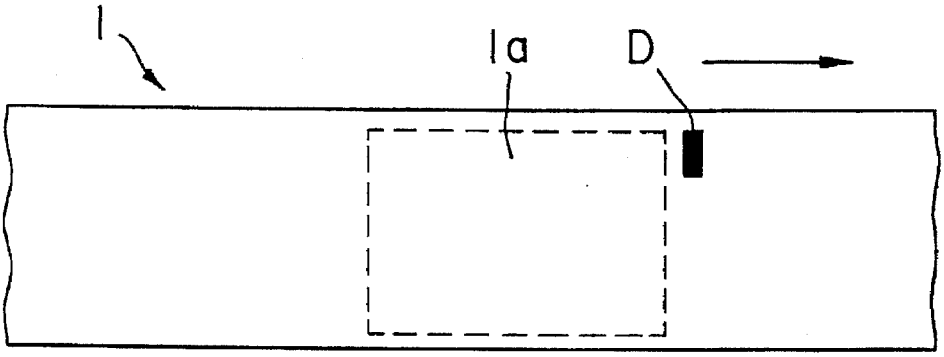
Figure 13C:
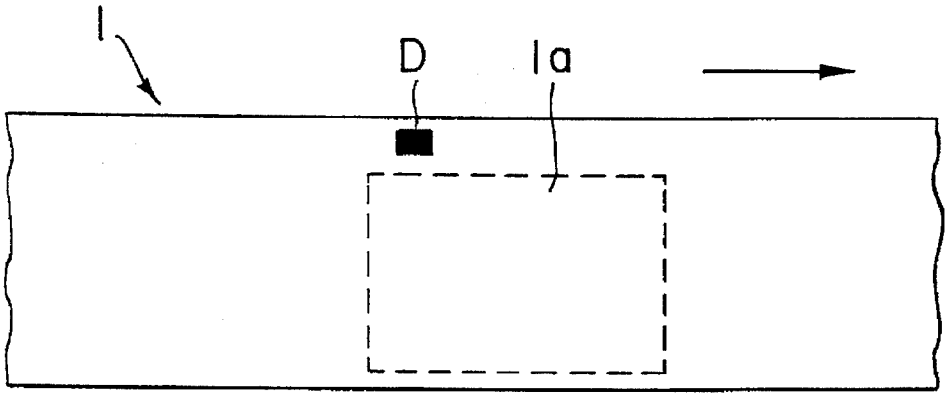

The positions at which the detection marks are provided on the surface of the intermediate transfer recording medium 1 can be determined in consideration of the operational order of the image recording printer as well as the positional relation between the heating means for the image forming section and the image transfer section and the means for detecting the detection marks. FIGS. 13*a*, 13*b* and 13*c* indicate examples of the positions of the detection marks. In FIG. 13*a*, a transversely elongated detection mark D is provided along the rear edge of the image forming area 1*a*. In FIG. 13*b*, a detection mark D is disposed adjacent the front edge of the image forming area 1*a* and near one longitudinal edge of the medium 1. In the example of FIG. 13*c*, a detection mark D is disposed adjacent one lateral side of the image forming area 1*a* toward the rear edge of the area. The detection marks could be provided at any appropriate position other than those shown in FIGS. 13*a* to 13*c*. The shape of the detection marks could be any shape other than those shown in the figures. A triangular, circular, elliptical or any other shape could be employed. The shape could also be a combination of the above mentioned shapes or even a letter.

The detection marks could be provided between the substrate and the image-receiving layer of the medium 1. When there are provided a plurality of image-receiving layers, the detection marks could be provided between image-receiving layers. The detection marks could also be provided on the outer surface of the image-receiving layer, on the rear surface of the substrate, or the front surface of the substrate having no image-receiving layer thereon.

According to the method and apparatus described above, images formed in image-receiving layers of an intermediate transfer recording medium can be selectively transfer-printed on a printing sheet in an exactly registered manner. Further, non-used portions of the intermediate transfer recording medium can be reduced to a minimum with resultant reduction of the cost of the transfer printing.

Figure 14:
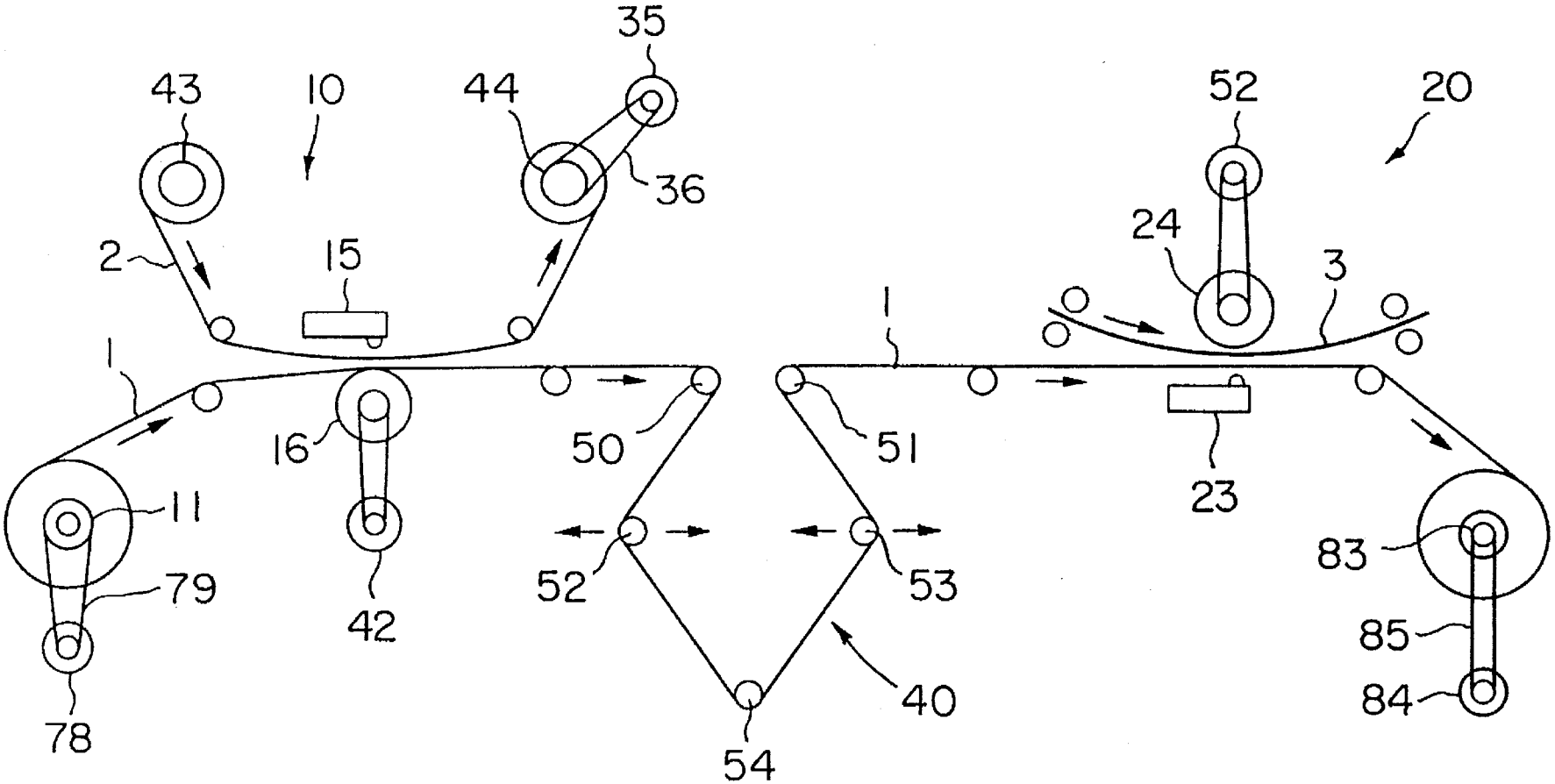
FIG. 14 is a schematic view of an apparatus for thermal transfer printing according to the present invention, having an image forming section and an image transfer section in a line.

FIG. 14 is a schematic illustration of a transfer printing apparatus according to another embodiment of the present invention. Referring to FIG. 14, reference numeral 10 denotes an image forming section, in which a thermal head 15 as a heating means is disposed opposite to a platen roller 16 between which a thermal transfer sheet 2 and an intermediate transfer recording medium 1 are fed. The platen roller 16 is driven and rotated by a stepping motor 42 at a predetermined speed, and the positional adjustment of the intermediate transfer recording medium 1 and the thermal transfer sheet 2 is performed in a state in which the thermal head 15 is separated from the platen roller The intermediate transfer recording medium 1 is conveyed and adjusted in longitudinal position as referred to hereinafter. The thermal transfer sheet 2 is fed in the longitudinal direction from a supply roll 43 and wound up by a takeup roll 44. During such feeding of the thermal transfer sheet 2, the positioning for a first color (yellow) is first performed. Upon completion of the positional adjustment of the intermediate transfer recording medium 1 and the thermal transfer sheet 2, the thermal head 15 is moved toward the platen roller 16 by a thermal head moving means, and the intermediate transfer recording medium 1 is pressed by the thermal head 15 against the platen roller 16 in a state overlapped with the thermal transfer sheet 2. In the next step, the platen roller 16 is rotated, and the intermediate transfer recording medium 1 is conveyed to the right, as viewed, together with the thermal transfer sheet 2, and in synchronism with this movement of the transfer recording medium 1, the thermal head 15 is selectively heated in accordance with image data from a thermal head driving circuit, whereby thermal transfer of the image of the first color (yellow color) is carried out.

Upon completion of the image transfer of the first color, the thermal head 15 is separated from the platen roller 16 by the thermal head moving means, and the positional adjustment of the intermediate transfer recording medium 1 and the thermal transfer sheet 2 is performed before image transfer of a second color (magenta). That is, the intermediate transfer recording medium 1 is wound back so that the front edge of an image forming area of the first color is overlapped with a line of a heat generation region of the thermal head 15. On the other hand, the thermal transfer sheet 2 is fed to the right, as viewed, by the takeup roll 44 to perform the positional adjustment for the second color. In the succeeding step, the image transfer of the second color is performed substantially in the same manner as that for the first color. In the like manner, a third color (cyan) image transfer is performed. Furthermore, as occasion demands, a black color image transfer may be performed in addition to the above three color image transfer.

In FIG. 14, reference numeral 20 denotes an image transfer section, in which a thermal head 23 as a heating means is provided opposite to a platen roller 24 as a pressure applying means between which the intermediate transfer recording medium 1 and a printing sheet 3, such as a sheet of paper, are conveyed. The platen roller 24 is rotated by a stepping motor 52 at a predetermined speed, and positional adjustment of the intermediate transfer recording medium 1 and the printing sheet 3 is performed in a state in which the thermal head 23 is separated from the platen roller 24.

When an image is transfer-printed in the image transfer section 20, the leading edge of an image forming area with an image formed therein, of the medium 1 is fed to the right into the nip of the thermal head 23 and the platen roller 24 to carry out positional adjustment of the transfer recording medium 1. On the other hand, the printing sheet 3 is fed by a printing sheet feeding means, not shown, and the positional adjustment is performed such that a position at which an image is to be printed on the printing sheet 3 is overlapped with the nip position of the thermal head 23 and the platen roller 24. Then, the thermal head 23 is pressed against the platen roller 24 by an elevating means, not shown, through the intermediate transfer recording medium 1 and the sheet 3. The platen roller 24 is then rotated to feed the intermediate transfer recording medium 1 and the sheet 3 to the right whereby an image transfer-printing process starts. When the intermediate transfer recording medium 1 has been conveyed to a rear edge of an image forming area and the transfer-printing operation has been completed, the thermal head 23 is separated from the platen roller 24 by the operation of the elevating means, and the printing sheet 3 is discharged by a sheet discharging means, not shown.

In FIG. 14, reference numeral 40 denotes a buffer unit disposed between the image forming section 10 and the image transfer section 20. The buffer unit 40 comprises a pair of stationary pulleys 50 and 51 arranged, with a space therebetween, on the way of the pass of the intermediate transfer recording medium 1, a pair of movable pulleys 52 and 53, which are adjustably movable in a direction along the pass of the medium 1 and which are disposed below the stationary pulleys 50 and 51, and one stationary pulley 54 disposed further below the pulleys 52 and 53. The intermediate transfer recording medium 1 is passed on these pulleys, forming a detouring path.

In this transfer-printing apparatus provided with the buffer unit 40, the image formation step and the image transfer step are carried out in a line in which the intermediate transfer recording medium 1 is passed from the image forming section 10 to the image transfer section 20 through the detouring route in the buffer unit 40. While the structure of the buffer unit 40 is not limited to a specific structure, it is only required that the pass length between the image forming section and the image transfer section be adjustable so as to independently control the operations in the image forming section and the image transfer section.

As described above, the thermal transfer sheet 2 is fed from the supply roll 43 and wound up around the takeup roll 44. The takeup roll 44 is connected to a pulley of a motor 35 through a belt 36, and the takeup roll 44 is rotated in a counter-clockwise direction through the control of the motor 35 by a motor driving circuit. In order to stably feed the thermal transfer sheet 2 without causing wrinkles and irregularities, it is preferred that a proper tension be applied to the thermal transfer sheet 2.

Figure 15:
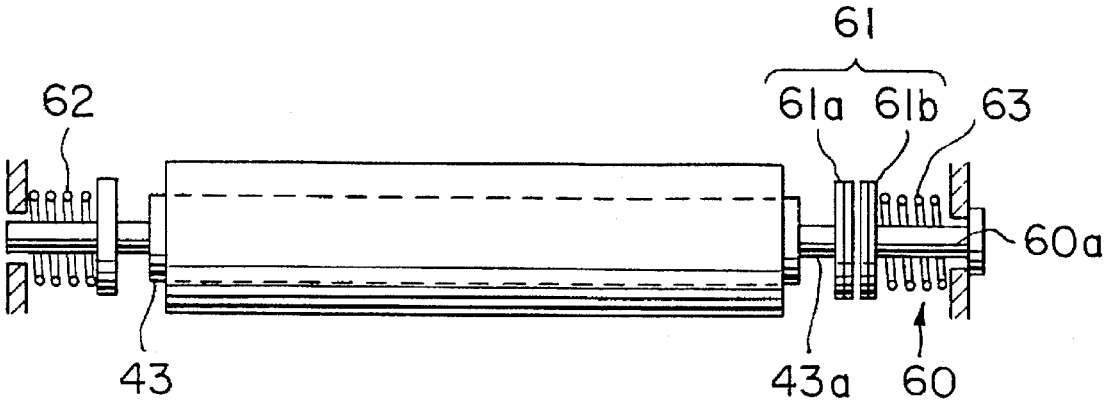
FIG. 15 is a view of a tension applying device for a thermal transfer sheet, provided at a supply roll for a thermal transfer sheet.

In order to apply a tension to the thermal transfer sheet 2 on the side of the supply roll 43 other than the side of the thermal head 15, a friction clutch 61 as shown in FIG. 15 may be disposed between a rotation shaft 43*a* of the supply roll 43 and a bearing 60. The friction clutch 61 comprises two friction discs 61*a* and 61*b* connected to rotation shaft 43*a* of the supply roll 43 and a shaft 60*a* supported by the bearing 60, respectively. These friction discs 61*a* and 61*b* are forcibly pressed by urging means 62 and 63 such as springs. When the thermal transfer sheet 2 is taken out from the supply roll 43, the friction disc 61*a* on the side of the rotation shaft 41*a* of the supply roll 43 is rotated together with the rotation shaft 43*a*, whereas the friction disc 61*b* on the side of the bearing 60 is not rotated. Therefore, when the thermal transfer sheet 2 is pulled out from the supply roll 43, it is necessary to pull the thermal transfer sheet 2 toward the thermal head 15 for applying a predetermined tension to the thermal transfer sheet 2 by applying a rotational torque of an amount overcoming the friction force between the two friction discs 61*a* and 61*b*, to the rotation shaft 43*a* of the supply roll 43. This tension can be adjusted by controlling the friction force between the two friction discs 61*a* and 61*b*.

Figure 16:
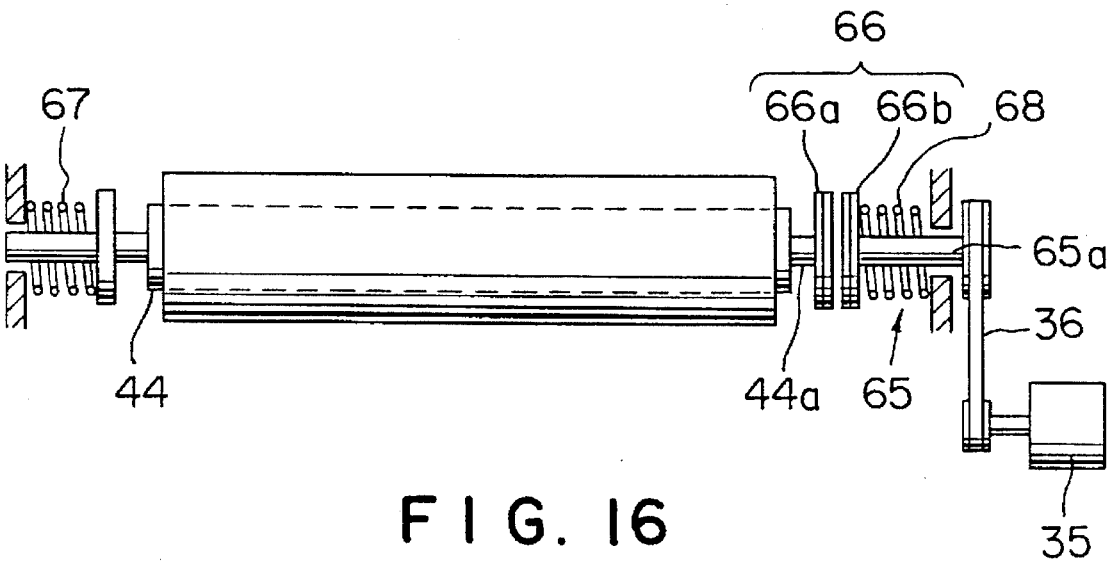
FIG. 16 is a view of a tension applying device for a thermal transfer sheet, provided at a takeup roll for the thermal transfer sheet.

In order to apply a tension to the thermal transfer sheet 2 positioned between the takeup roll 44 and the thermal head 15, a friction clutch 66 as shown in FIG. 16 may be disposed between a rotation shaft 44*a* of the takeup roll 44 and a rotation shaft 65*a* supported by a bearing 65 on the side of the motor 35. The friction clutch 66 comprises two friction discs 66*a* and 66*b* connected to the rotation shafts 44*a* and 65*a*, respectively. These friction discs 66*a* and 66*b* are forcibly pressed by urging means 67 and 68 such as springs. When the thermal transfer sheet 2 is wound up around the takeup roll 44, the rotational torque of the motor 35 is transmitted to the rotation shaft 44*a* of the takeup roll 44 through the friction clutch 66. Accordingly, the friction force is produced between the two friction discs 66*a* and 66*b* by increasing the rotational speed of the rotation shaft 65*a* on the side of the motor 35, by a rotational speed of the takeup roll 44 corresponding to a delivery speed of the thermal transfer sheet 2, thus applying a tension to the thermal transfer sheet 2. This tension can be adjusted by controlling the friction force between the two friction discs 66*a* and 66*b* and by controlling the rotational speed of the motor 35.

The advance feeding of the intermediate transfer recording medium 1 in the image forming section 10 is performed by means of the platen roller 16 and the movable pulley 52 disposed in the buffer unit 40. The movable pulley 52 is urged to the left by urging means such as a spring, and the intermediate transfer recording medium 1 is pulled rightward by this urging force. During the image transfer process, the intermediate transfer recording medium 1 is delivered from the supply roll 11 and conveyed rightward as viewed in the figure by the rotation of the platen roller 16. The medium 1 passing the thermal head 15 is pulled and conveyed rightward by leftward movement of the movable pulley 52 in the buffer unit 40. On the other hand, the medium 1 is conveyed leftward by the supply roll 11 in such a manner that the supply roll 11 connected to a pulley of a motor 78 through a belt 79 is rotated counterclockwisely under the control of the motor 78 by means of a motor driving circuit, whereby the intermediate transfer recording medium 1 is fed in the leftward direction.

Figure 17:
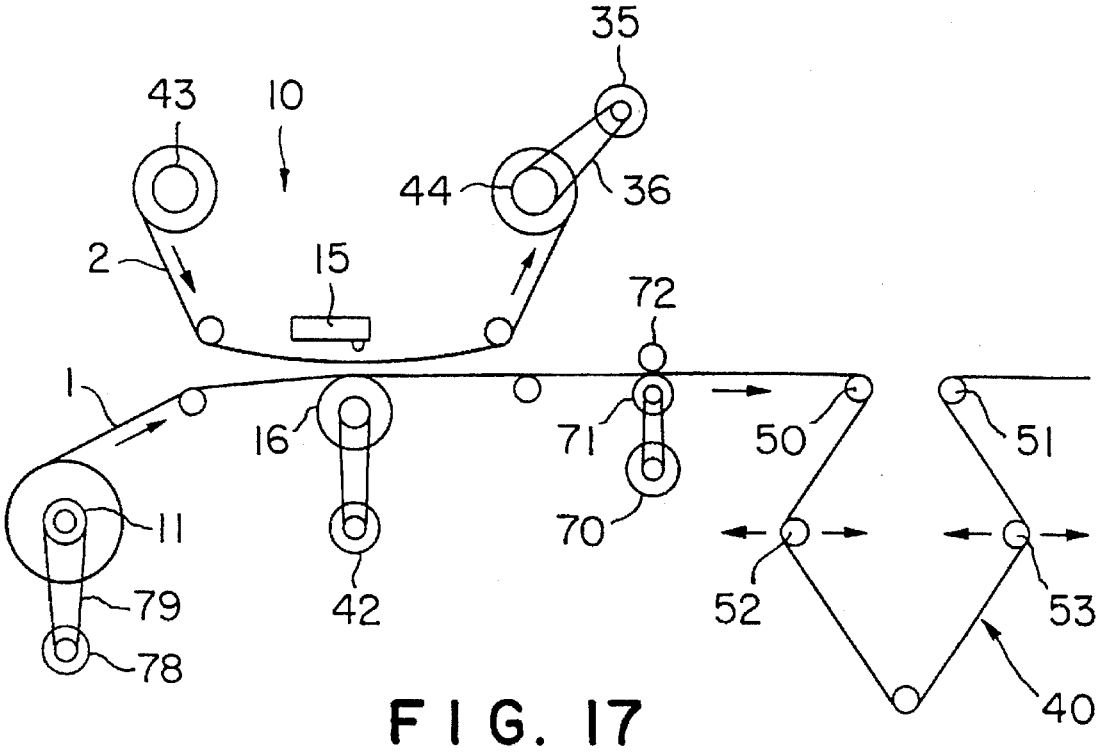
FIG. 17 is a view showing a tension applying device for the intermediate transfer recording medium, provided between an image forming section and a buffer device.

In order to more exactly control the tension to be applied to the recording medium 1 passing between the image forming section 10 and the buffer unit 40, thereby to stably convey the medium 1, a capstan roller 71 and a nip roller 72 in a pair arrangement may be provided between the thermal head 15 and the buffer unit 40, as shown in FIG. 17. The capstan roller 71 is driven by a motor 70 so as to rotate at a constant speed, and the nip roller 72 is adapted to press the recording medium 1 against the capstan roller 71. In the arrangement shown in FIG. 17, the capstan roller 71 acts as a driving means for conveying the recording medium 1 in a rightward direction as viewed in FIG. 17.

In the arrangement of FIG. 14, the movable pulley 52 of the buffer unit 40 is urged by a spring, so that when the length of the intermediate transfer recording medium 1 in the buffer unit 40 is changed, the position of the movable pulley 52 will also be changed and hence the urging force applied to the movable pulley 52 will vary. On the contrary, according to the arrangement of FIG. 17 in which the paired rollers 71 and 72 are disposed between the thermal head 15 and the buffer unit 40, it becomes possible to control to be constant the tension applied to the recording medium 2 passing between the thermal head 15 and the paired rollers 71 and 72, even if the position of the movable pulley 52 is changed, by making the linear speed at a surface with which the capstan roller 71 contacts the recording medium 1 slightly larger than the linear speed of the platen roller 16. As described above, the location of the paired rollers 71 and 72 between the thermal head 15 and the buffer unit 40 makes it possible to prevent generation of wrinkles or irreguralities of the recording medium 1 due to the variation of the tension.

Figure 18:
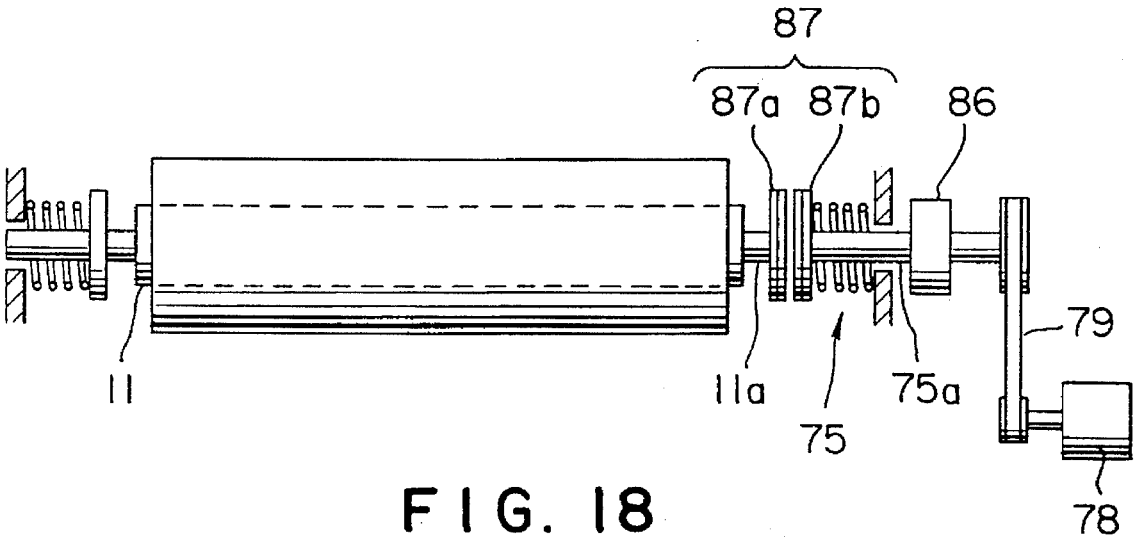
FIG. 18 is a view of a tension applying device for the intermediate transfer medium, provided at a supply roll for the medium.

In the meantime, in order to make stable the feed of the recording medium 1, it is desirable to apply a proper tension to the recording medium 1 passing between the platen roller 16 and the supply roll 11. FIG. 18 shows a structure for applying such proper tension comprising a one-way clutch 86 and a friction clutch 87 provided between a rotated shaft 11*a* of the supply roller 11 and a bearing 75 on the side of the motor 78. The one-way clutch 86 is designed such that when the rotation shaft 11*a* of the supply roll 11 is rotated in a clockwise direction as viewed in FIG. 14, the structure on the side of the supply roll 11 and the structure on the side of the bearing 75 are rotated relative to each other, and on the other hand, when the rotation shaft 11*a* is rotated in a counterclockwise direction, both the rotation shafts 11*a* and 75*a* of the supply roll 11 and the bearing 75 are made rotatable together. According to this structure, when the recording medium 1 is paid out from the supply roll 11, a tension corresponding to a friction force between the two friction discs 87*a* and 87*b* of the friction clutch 87 is applied to the recording medium 1.

Figure 19:
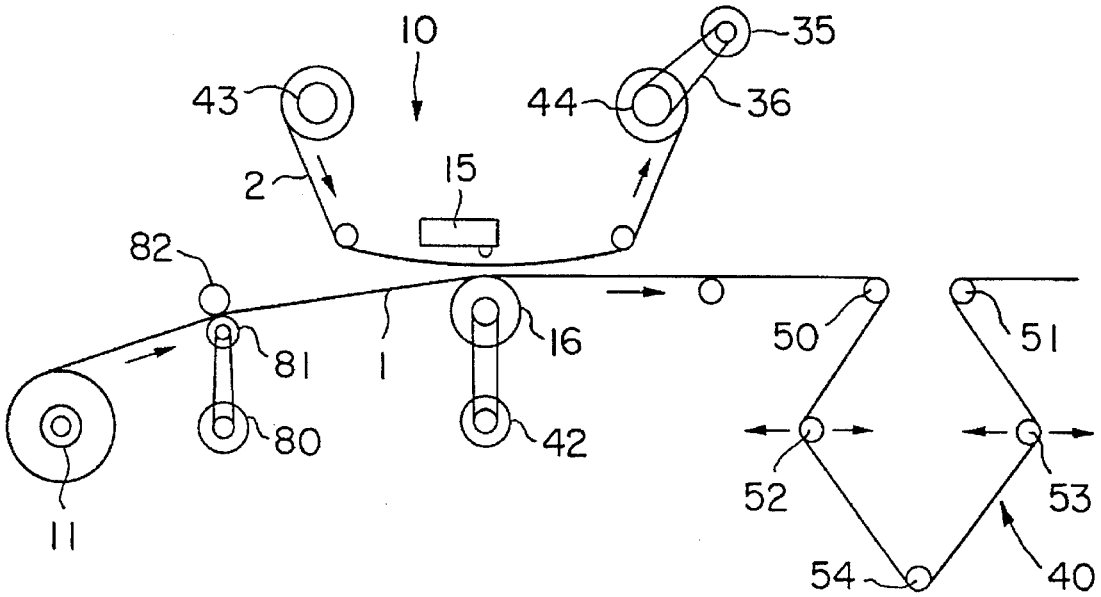
FIG. 19 is a view showing a tension applying device provided between a supply roll for the intermediate transfer recording medium and a platen roll.

In a modification as shown in FIG. 19, a pair of a capstan roller 81 and a nip roller 82 are disposed between the supply roll 11 and the platen roller 16. The capstan roller 81 is driven by a motor 80 at a constant speed and the nip roller 82 is adapted to press the recording medium 1 against the capstan roller 81. In this modified arrangement, the recording medium 1 can be supplied from the supply roll 11 by rotating the capstan roller 81 at a predetermined rotational speed. Further, in the case where, as described above, only the one-way clutch 86 and the friction clutch 87 are utilized, the driving force is transmitted by the friction force between the two friction discs 87*a* and 87*b*, so that the rotating amount of the motor 78 does not correspond to the moving amount of the recording medium 1. However, in the case of the use of the paired rollers, the rotating amount of the motor 78 is proportional to the moving amount of the recording medium 1, so that the positional adjustment of the recording medium 1 can be exactly performed by controlling the rotating amount of the motor 80. Furthermore, when the recording medium 1 is conveyed to the right as viewed in the figure, it becomes possible to control to be constant the tension applied to the recording medium 1 passing between the thermal head 15 and the paired rollers 81 and 82, even if the diameter of the supply roll 11 varies by making the linear speed at the surface with which the capstan roller 71 contacts the recording medium 1 slightly smaller than the linear speed of the platen roller 16. Further, the paired rollers 81 and 82 may be used in combination with the one-way clutch 86 and the friction clutch 87.

In the above embodiments, although it was described that the platen roller 16, the takeup roll 44 for the thermal transfer sheet 2, and the capstan roller 71 (81) are driven by respective independent motors, these members may be driven commonly by a single motor means.

The rightward feed of the intermediate transfer recording medium 1 in the image transfer section 20 is performed by a takeup roll 83 in such a manner that the takeup roll 83 connected to a pulley of a motor 84 through a belt 85 is rotated in the clockwise direction under the control of the motor 84 by means of motor driving circuit. In a condition in which the thermal head 23 is separated from the platen roller 24, the intermediate transfer recording medium 1 is fed from the buffer unit 40 to the side of the takeup roll 83 by the rotation of the roll 83. On the other hand, in a condition in which the thermal head 23 is pressed against the platen roller 24, the recording medium 1 is fed rightwardly from the buffer unit 40 by the rotation of the platen roller 24, and the recording medium 1 passing the platen roller 24 is then wound up by the takeup roll 83.

Figure 20:
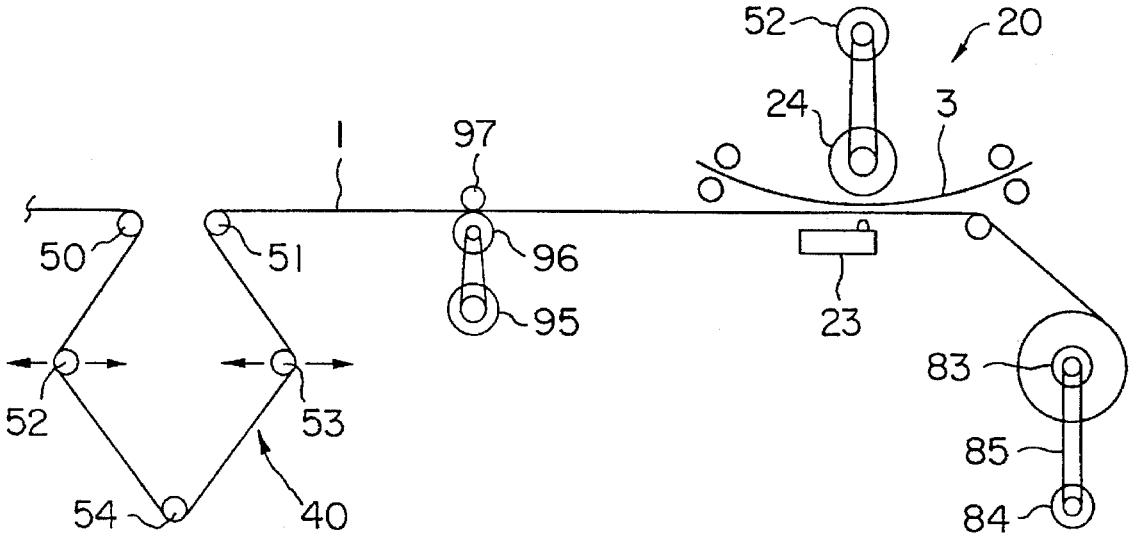
FIG. 20 a view showing a tension applying device provided between the buffer device and an image transfer section.

In the above arrangement, the movable pulley 52 in the buffer unit 40 is urged rightward as viewed in the figure by urging means, not shown, and a back-tension for pulling the recording medium 1 to the side of the buffer unit 40 is applied to it during the passage through the image transfer section 20. Accordingly, the intermediate transfer recording medium 1 can be fed to the side of the takeup roll 83 from the buffer unit 40 by further applying the back-tension to the side of the takeup roll 83. However, since the urging means for the movable pulley 52 is composed of a spring or the like, the back-tension may vary in accordance with the position of the movable pulley 52, and hence, wrinkles or irregularities, which will cause an image transfer defect, is likely to be caused on the recording medium 1. In order to make stable the feed of the recording medium 1, it is desirable, as shown in FIG. 20, to provide, between the buffer unit 40 and the platen roller 24, a pair of a capstan roller 96 driven by a motor 95 so as to rotate the same at a constant speed and a nip roller 97 for pressing the recording medium 1 against the capstan roller 96. According to this arrangement, the capstan roller 96 is rotated at a predetermined speed, thereby feeding the recording medium 1 from the buffer unit 40 to the image transfer section 20. Furthermore, it becomes possible to control to be constant the linear speed at a surface with which the capstan roller 96 contacts the recording medium 1 regardless of the position of the movable pulley 52 by making the linear speed slightly smaller than the linear speed of the platen roller 24. In the present embodiment, although independent motors are provided for independently driving the takeup roll 83 and the capstan roller 96, a common single motor may be utilized instead.

Although, as heating means in the image forming section 10, a thermal head is mainly utilized, a thermal head, a heat roll or a hot stamping may be utilized as heating means in the image transfer section 20 without being limited thereto.

Figure 21:
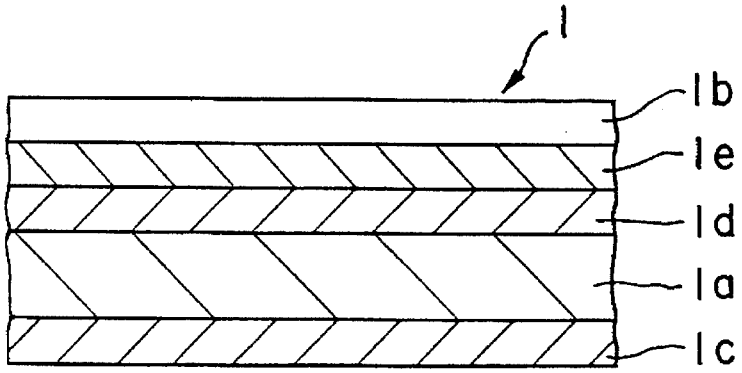
FIG. 21 is a sectional view of an intermediate transfer recording medium.

FIG. 21 is a partial sectional view of the intermediate transfer recording medium 1, which is formed essentially of a substrate sheet 1*a* and an image receiving layer 1*b* formed releasably on one surface of the substrate sheet 1*a*. A back surface layer 1*c* may be provided on the other surface of the substrate sheet 1*a* to improve slidability between the recording medium 1 and a heating means such as the thermal head. Furthermore, a releasing layer 1*b* may be provided between the substrate sheet 1*a* and the image receiving layer 1*b* to control the release of the image receiving layer 1*b* from the substrate sheet 1*a*. Still furthermore, in order to protect the image receiving layer 1*b* to be transfer-printed to the printing sheet, an image protective layer 1*e* may be provided between the substrate sheet 1*a* and the image receiving layer 1*b*. The protective layer 1*e* is transferred to the printing sheet together with the image receiving layer 1*b* to improve weather resistance and durability against finger prints, chemicals or the like.

Figure 22:
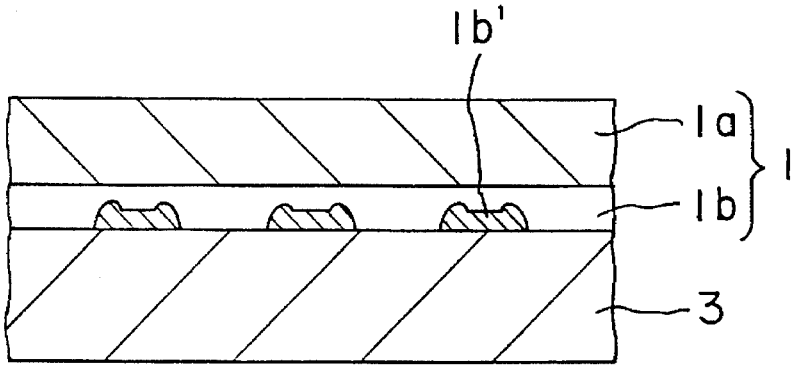
FIG. 22 is a view showing an image receiving layer of the intermediate transfer recording medium as well as a printing sheet, the recording medium and the printing sheet being shown in a mutually superposed state.

FIG. 22 is a sectional view showing a printing sheet 3 and an image receiving layer 1*b* of the recording medium 1. The image-receiving layer 1*b* and the printing sheet 3 are superposed with an image 1*b* of coloring material therebetween.

Figure 23:
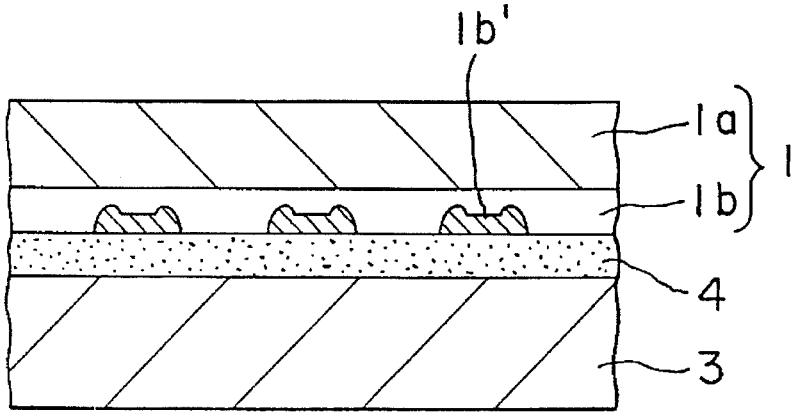
FIG. 23 is a view showing an image-receiving layer and a printing sheet, the image-receiving layer and the printing sheet being shown in a mutually attached state via a bonding layer.

As shown in FIG. 23, an image-receiving layer 1*b* having an image 1*b*' of coloring material formed therein may be transfer-printed to the printing sheet 3 through an adhesive layer 4.

As described hereinbefore, when a thermal head is used to transfer an image-receiving layer to a printing sheet, pulses of repetitive heating and cooling are given to the thermal head. A thermal head has a large number of heating resistors arranged on every picture element in the main-scanning direction, so that non-heating portions are produced between electrodes provided in the main-scaning direction, and it is thus difficult to uniformly heat the image-receiving layer. For these reasons, the image-receiving layer tends to have a crack after it is transfered to the printing sheet. There are other problems as set forth hereinbefore. These problems can be solved by using a line heater as heating means in the image transfer section. Examples of such line heater will be described below.

Figure 24:
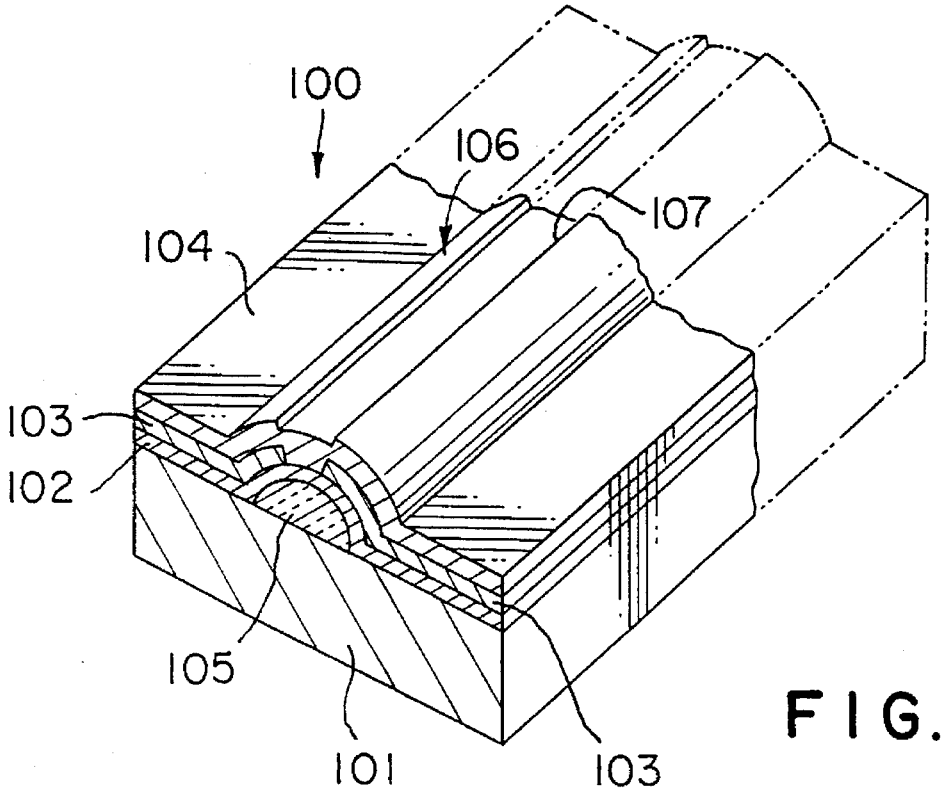
FIG. 24 is a perspective view, in section, showing the structure of a thin-layer-type line heater used for transferring an image-receiving layer to a printing sheet.

FIG. 24 shows a structure of a thin-layer-type line heater 100. This line heater 100 has a heat radiating substrate 101 on which are provided a rod-like bulging heat-resistive layer 105, a heating resistor 102, a pair of electrodes 103 and an abrasion-resistant layer 104. The heat radiating substrate 101 is made from ceramics or the like. The bulging heat-resistive layer 105 is made from glass or the like and is provided on the radiating substrate 101 with a smaller width than the substrate. A suitable thickness of the heat-resistive layer 105 at the rounded top thereof is from 20 to 150 μm, and the suitable thermal conductivity is from 0.1 to 2 Watt/m.deg. The heating resistor 102 is made from $Ta_2N$, W, Cr, Ni—Cr, $SnO_2$ or the like and is formed by utilizing a thin-layer-forming technique such as vacuum deposition, CVD or sputtering. A suitable thickness of the heating resistor 102 is from 0.05 to 3 μm. The resister 102 covers the bulging heat resistive layer 105 as shown. The electrodes 103 are made from A1 or the like and formed in a pair on the heating resistor 2 with a clearance on and along the top of the heat-resistive layer 105 for applying an electric current to the heating resistor 102 between the electrodes 103. A suitable thickness of each electrode 3 is from 0.1 to 3 μm. The abrasion-resistant layer 104, which is made from $Ta_2O_3$ or the like, may further contain, on the electrode side, a layer to which oxidation resistance is imparted. A suitable thickness of the abrasion-resistant layer 104 is from 1 to 20 μm. It will be noted that the abrasion-resistant layer 104 has an elongated bulged top 106 raised from the surface of the layer 104 and formed with a longitudinal groove 107, and the bulged top 106 forms a linear heater top.

When an electric current is applied, through the electrodes 103, to the heating resistor 102 of the line heater, a portion of the heating resistor 102 between the electrodes 103 generates heat, and this heat is diffused mainly to the upper and lower direction of this portion. The heat diffused upward is transmitted, through the abrasion-resistant layer 104, to an intermediate transfer recording medium and a printing sheet which are brought into pressure contact with each other by the line heater 100. On the other hand, the heat diffused downward is transmitted to the heat radiating substrate 101 through the heat-resistive layer 105. The diffusion of the heat from the heating resistor 102 to the radiating substrate 101 can be properly controlled by the heat-resistive layer 105. When the heat resistance of the heat-resistive layer 105 is too small, the amount of the heat transmitted to the abrasion-resistant layer becomes small, so that the heating efficiency becomes poor. An excessively large amount of electricity is therefore required to heat the intermediate transfer recording medium and the printing sheet to a desired temperature. On the other hand, when the heat resistance of the heat-resistive layer 105 is too large, the response to heat of the line heater 100 becomes slow. In order to make the heat resistance of the heat-resistive layer 105 proper, it is necessary to properly select the thermal conductivity, heat capacity and thickness of the heat-resistive layer 105.

A temperature sensor may be attached to the upper surface or back surface of the radiating substrate 101 to measure the temperature thereof. On the basis of the temperature measured, the surface temperature of the line heater can be accurately controlled by a temperature controller, which is not shown in the figure. A thermistor, a thermocouple or the like can be mentioned as the temperature sensor.

Figure 25:
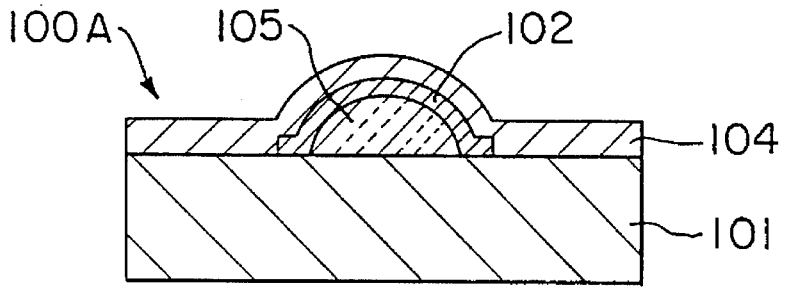
FIG. 25 is a cross-sectional view showing the structure of a thin-layer-type line heater used for transferring an image-receiving layer to a printing sheet.
Figure 30:
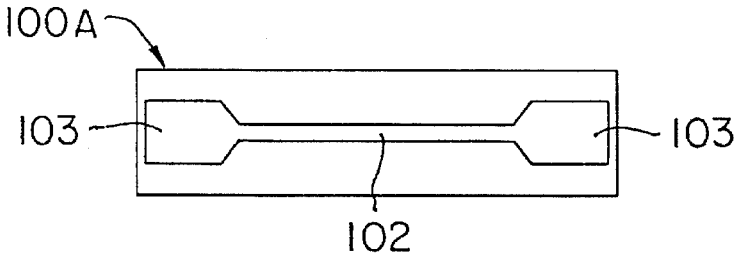
FIG. 30 is a plan view of another line heater.

FIG. 25 shows a cross section of another preferred embodiment of a thin-layer-type line heater 100A, in which a heating resister 102 is of a smaller width than that shown in FIG. 24. No electrodes 103 are shown but in this embodiment, electrodes 103 are provided at the two longitudinal ends of the resistor 102 as shown in FIG. 30.

Figure 26:
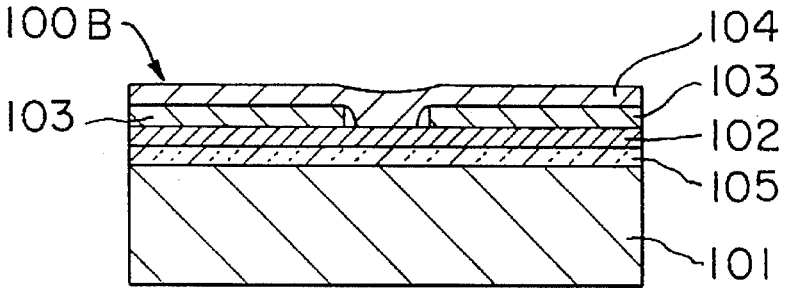
FIG. 26 is a sectional view showing the structure of another thin-layer-type line heater used for transferring an image-receiving layer to a printing sheet.

Still another preferred embodiment of the thin-layer-type line heater 10B is shown in FIG. 26. The line heater 100B of this embodiment is the same as the line heater 100 shown in FIG. 24 except that a flat heat-resistive layer 105 is provided on the radiating substrate 101. The line heaters shown in FIGS. 24 and 25 are referred to as a line heater of partially-glazed type, and the line heater shown in FIG. 26 is referred to as a line heater of entirely-glazed type. The line heaters of partially-glazed type can be brought into closer contact with a printing sheet than that of entirely-glazed type, so that it can attain high-speed and uniform printing.

Figure 27:
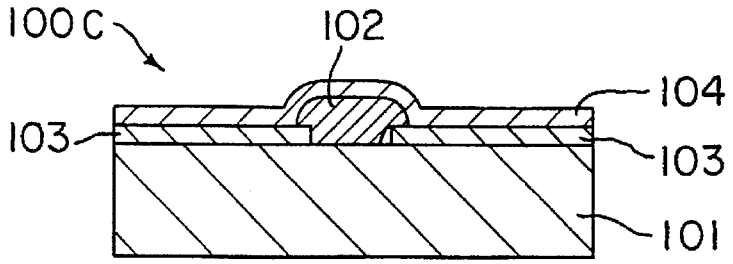
FIG. 27 is a cross-sectional view of a another line heater.

One example of the structure of a thick-layer-type line heater 100C is shown in FIG. 27. In this line heater, a heating resistor 102, an electrode 103 and an abrasion-resistant layer 104 are provided on a radiating substrate 101. The radiating substrate 101 is made from ceramics or the like. The heating resistor 102 is made from a paste containing a resistive material such as Pd—Ag or $RuO_2$ and formed in the shape of a line by means of screen printing or the like. A suitable thickness of the heating resistor 102 is from 0.1 to 20 μm. The electrodes 103 are made from Au or the like, and a suitable thickness thereof is from 0.1 to 10 μm. The abrasion-resistant layer 104 is made from glass or the like, and the suitable thickness thereof is from 0.1 to 15 μm.

The line heater of this structure can be obtained by the printing technique, so that it can be mass-produced. The production cost can thus be decreased.

Figure 28:
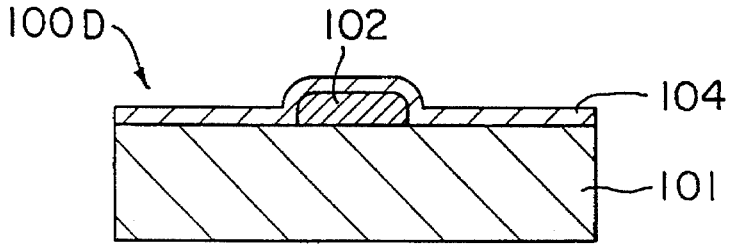
FIG. 28 is a cross-sectional view of a further line heater.

A line heater 100D shown in FIG. 28 has the same structure as the line heater 100C of FIG. 27 except that the line heater 100D has electrodes 103 at the two longitudinal ends of the resister 102 as exemplified in FIG. 30.

Not only the line heaters of the above-described structures but also a line heater which is obtained by attaching electrodes to a line-shaped heating resistor prepared by using a resin or a conductive resin into which sintered ceramics or a conductive filler is incorporated may be employed. Such a line heater may further comprise, when necessary, an abrasion-resistant layer in order to protect the heat-generating resistor from abrasion by a sheet.

Figure 29:
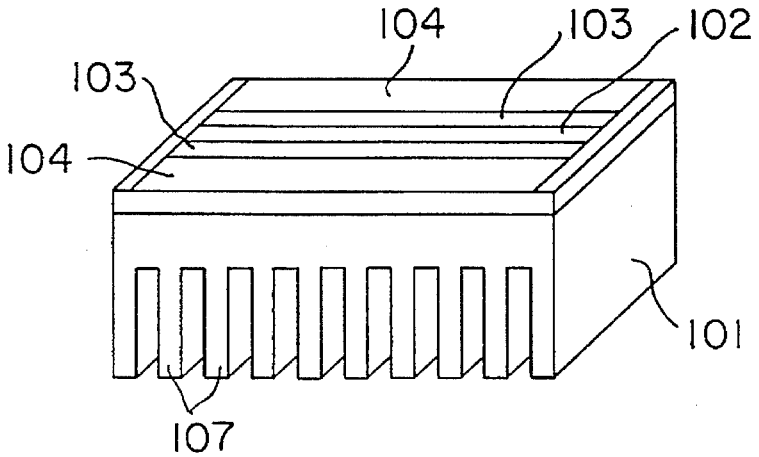
FIG. 29 is a plan view of a line heater.

The structure of the electrodes 103 of the line heater may be as shown in FIG. 29, in which the electrodes 103 are provided in parallel on both sides of the heating resistor 102 in the longitudinal direction thereof. Alternatively the structure of the electrodes may be as shown in FIG. 30 in which the electrodes 103 are provided on the two longitudinal ends of the heating resistor 102. Both of these structures are acceptable.

FIG. 29 shows that the heat radiating substrate 101 may have a number of heat dissipating fins 107.

The length of the line heater in the main-scanning direction varies depending upon the width of the image-printing area. In the case of A6 size sheet, it is approximately 100 mm, and in the case of A4 size sheet, approximately 210 mm. The distance between the electrodes 103, that is, the length of the' heating resistor in the sub-scanning direction (the direction of feeding) can be properly selected depending on the resistance of the heating resistor, and on the contact time of the heating resistor with the intermediate transfer recording medium. However, it is desirably about 10 μm to 10 mm.

Figure 31:
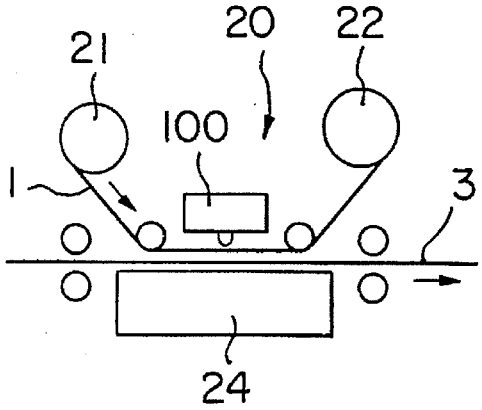
FIG. 31 is an illustration of an apparatus for thermal transfer recording in which a line heater is used for transferring an image-receiving layer to a printing sheet.

FIG. 31 is an illustration showing an image transfer section 20 in which the line heater 100 is used. In this embodiment, the image transfer section 20 is fabricated separately from an image forming section. The line heater 100 is provided in confrontation with a platen 24. The same numerals as used in FIG. 2 denote the equivalent parts.

In all of the line heaters described above, the transverse dimension across the line heating area of the heater is from 10 to 500 μm and preferably from 200 to 300 μm.

In this embodiment, a temperature sensor may be attached to the line heater 100 although it is not shown in the figure. The temperature of the line heater 100 is measured by this temperature sensor; the surface temperature of the line heater 100 can be precisely controlled by controlling the application of an electric current to the line heater on the basis of the temperature data obtained.

When the adhesion between the image-receiving layer and the printing sheet is insufficient, it is possible to transfer the image-receiving layer to the printing sheet after an adhesive layer is provided thereon.

Figure 32:
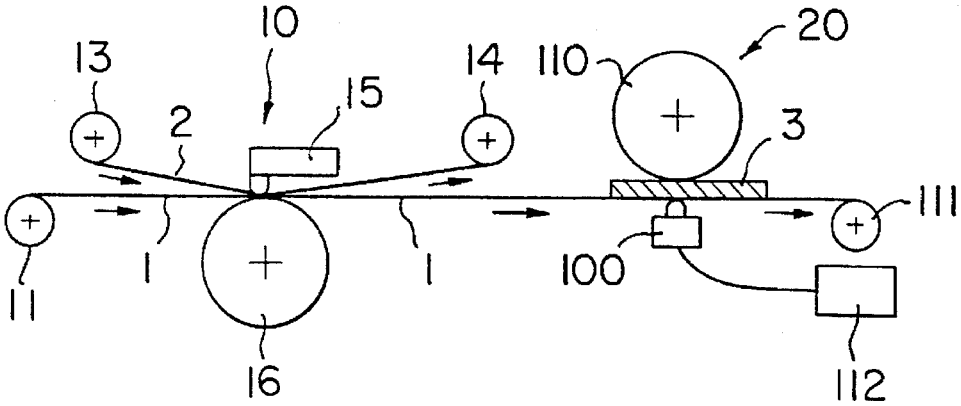
FIG. 32 is an illustration of another apparatus having a line heater incorporated therein.

FIG. 32 is an illustration explaining an in-line thermal transfer printing system in which the line heater 100 is used. The image forming section 10 shown is equivalent to that shown in FIG. 14. An intermediate transfer recording medium 1 having an image formed thereon in the section 10 is fed to the image transfer section 20. The intermidiate transfer recording medium 1 and a printing sheet 3 are brought into pressure contact with each other between a line heater 100 and a platen 110. The recording medium 1 is heated from the back surface thereof by the line heater 100, whereby the image-receiving layer having the image thereon is transferred to the printing sheet 3. The recording medium 1 is taken up by a roll 111.

In this embodiment, a temperature sensor 112 may be attached to the line heater 100. The temperature of the line heater 100 is measured by this temperature sensor 112; the surface temperature of the line heater 100 can thus be precisely controlled by controlling the application of an electric current to the line heater 100 on the basis of the temperature data obtained.

In order to lighten the load on the intermediate transfer recording medium 1 given by the friction between the recording medium 1 and the line heater 100, a film-feeding mechanism using a seamless film may be provided. Polyimide or the like can be used for the seamless film.

Figure 33:
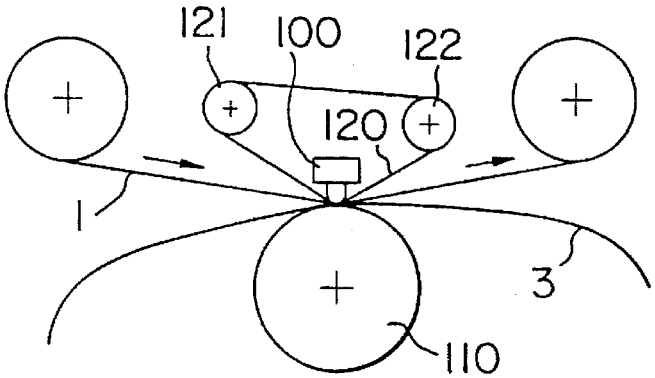
FIG. 33 is an illustration showing an apparatus in which a film-feeding mechanism using a seamless film is provided.

FIG. 33 shows an example in which a film-feeding mechanism using a seamless film is provided. A seamless film 120 is fed by a driving roller 121 and a tension roller 122. The intermediate transfer recording medium 1 is heated by a line heater 100 through the seamless film 120. Due to the presence of this seamless film 120, the recording medium 1 can be prevented from wrinkling or the like, and can be fed smoothly. Moreover, when the material for the seamless film 120 is properly selected, there is no need to provide a heat-resistant slippery layer on the recording medium 1. The cost can thus be reduced.

The transfer area of the image-receiving layer to the printing sheet can be changed by changing the shape of the heating element of the line heater, or by ON-OFF control of energy applied to the line heater, or by controlling the patterning of the transfer area in the direction of feeding, such as the raising or lowering of the line heater.

Figure 34:
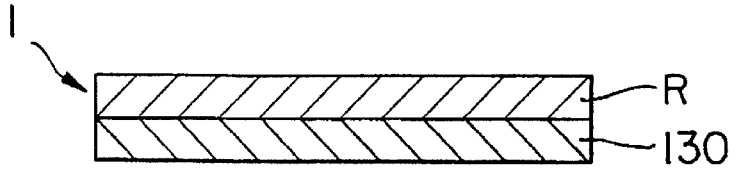
FIGS. 34 to 37 are sectional views showing sectional structures of various intermediate transfer recording mediums.

FIG. 34 shows an example of the intermediate transfer recording medium 1 used. An image-receiving layer R is provided on one surface of a substrate sheet 130 releasably from the substrate sheet.

Materials for the substrate sheet 130 of the recording medium 1 are not limited to those materials which have a micro-void layer, such as polyolefin or polystyrene synthetic paper, and any of the substrate sheets which are used in the conventional heat transfer printing sheets can be used as it is as the substrate sheet.

Figure 35:
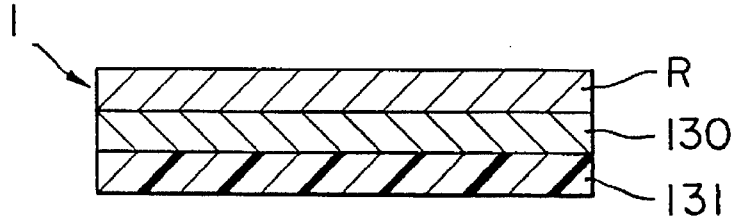

In order to prevent the thermal fusion between the intermediate transfer recording medium and a heating device such as the thermal head or the line heater, and to make the recording medium smoothly move on the heating device, a heat-resistant slippery layer 131 may be provided, as shown in FIG. 35, on the surface of the substrate sheet 130, opposite to the surface on which the image-receiving layer R is provided.

Examples of a resin which is used for forming the heat-resistant slippery layer 131 include cellulose resins such as ethyl cellulose, hydroxy cellulose, hydroxypropyl cellulose, methyl cellulose, cellulose acetate, cellulose acetate butyrate and nitrocellulose, vinyl resins such as polyvinyl alcohol, polyvinyl acetate, polyvinyl butyral, polyvinyl acetal and polyvinyl pyrrolidone, acrylic resins such as polymethyl methacrylate, polyethyl acrylate, polyacrylamide and an acrylonitrile/styrene copolymer, polyamide resins, vinyltoluene resins, coumarone-indene resins, polyester resins, polyurethane resins, silicone-modified urethanes and fluorine-modified urethanes. These resins can be used either singly or in combination. In order to further enhance the heat resistance, a crosslinked resin layer which can be obtained by the combination use of a resin having a reactive group such as a hydroxyl group, selected from the above resins and a crosslinking agent such as polyisocyanate may also be used as the heat-resistant slippery layer.

In order to make the intermediate transfer recording medium move on a heating device more smoothly, a solid or liquid releasing agent or lubricant may also be incorporated into the heat-resistant slippery layer 131 to impart thereto heat-resistant slipperiness. Examples of the releasing agent or lubricant which can be used include waxes of various types such as polyethylene wax and paraffin wax, higher fatty alcohols, organopolysiloxane, anionic surface active agents, cathionic surface active agents, ampholytic surface active agents, nonionic surface active agents, fluorine-containing surface active agents, organic carboxylic acids and derivatives thereof, fluororesins, silicone resins, and fine particles of inorganic compounds such as talc and silica. The amount of the releasing agent or lubricant incorporated into the heat-resistant slippery layer 131 is preferably 5 to 50% by weight, more preferably about 10 to 30% by weight of the total solid of the heat-resistant slippery layer. The heat-resistant slippery layer 131 can be formed in the same manner as in the formation of the above-described image-receiving layer, and the thickness thereof is preferably about 0.1 to 10 μm.

Figure 36:
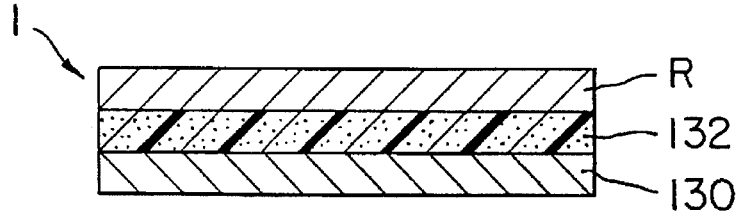

A releasing layer 132 may be provided between the substrate sheet 130 and the image-receiving layer R as shown in FIG. 36 in order to control the release of the image-receiving layer R from the substrate sheet 130. The image-receiving layer 130 is released from the releasing layer 132, and the releasing layer 132 remains on the substrate sheet 131. The releasing layer 132 is made from a composition prepared by adding a suitable material having release properties to a binder resin, or from a resin having release properties.

In the case where the releasing layer 132 is formed by using a composition which is prepared by adding a suitable material having release properties to a binder resin, any of the following resins can be used as the binder resin: thermoplastic resins, for example, acrylic resins such as polymethyl methacrylate, polyethyl methacrylate and polybutyl acrylate, vinyl resins such as polyvinyl acetate, a vinyl chloride/vinyl acetate copolymer, polyvinyl alcohol and polyvinyl butyral, and cellulose derivatives such as ethyl cellulose, nitrocellulose and cellulose acetate; and thermosetting resins such as unsaturated polyester resins, polyester resins, polyurethane resins and aminoalkyd resins. The releasing layer can be made from a composition containing one or more of the above resins. Waxes, silicone waxes, resins having release properties such as silicone resins, melamine resins and fluororesins, fine particles of talc and silica, and lubricants such as surface active agents and metallic soaps can be used as the materials having release properties.

In the case where the releasing layer 132 is made from a resin having release properties, a silicone resin, a melamine resin, a fluororesin or the like can be used. It is also possible to use a graft polymer obtained by grafting a segment having release properties such as a polysiloxane segment or a carbon fluoride segment to a resin molecule of an acrylic, vinyl or polyester resin. The releasing layer can be formed by using one or more of the above-described resins.

The releasing layer 132 can be formed in the same manner as in the formation of the above-described image-receiving layer R, and the thickness thereof is preferably from 0.1 to 5 μm.

Figure 37:
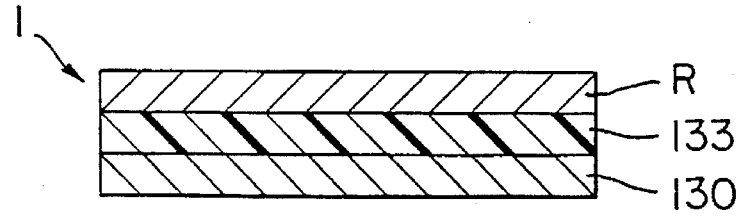

In order to protect the image-receiving layer R which will be transferred, together with an image formed thereon, to a printing sheet, an image-protective layer 133 may be provided between the substrate sheet 130 and the image-receiving layer R as shown in FIG. 37. After this image-protective layer 133 is transferred to a printing sheet together with the image-receiving layer R, it is positioned at the uppermost surface of the image-receiving layer R on the printing sheet, and thus improves the resistance to weather, fingerprints and chemicals of the image.

The image-protective layer 133 comprises at least a binder resin. To form the image-protective layer 54, it is necessary to select such a resin composition that can form a layer which has the properties of being properly released from the substrate sheet 130, and which shows desired physical properties as the protective layer of the image-receiving layer R after it is transferred to a printing sheet together with the image-receiving layer R In the case where image-printed sheet finally obtained by transferring the image-receiving layer to a printing shet is particularly required to have resistance to abrasion, chemicals and stain, an ionizing-radiation-hardening resin may also be used as the resin for forming the image-protective layer. Further, to the above-enumerated resins may be added a lubricant in order to improve the friction resistance of the image-printed matter, a surface active agent in order to protect the image-printed matter from staining, and an ultraviolet-absorbing agent or an antioxidant in order to improve the weather resistance of the image-printed matter. The image-protective layer 133 can be formed in the same manner as in the formation of the above-described image-receiving layer, and the thickness thereof is preferably from 0.1 to 20 μm.

An intermediate transfer recording medium which is obtained by providing a releasing layer 132, an image-protective layer 133 and an image-receiving layer R on a substrate 130 in the mentioned order can be used although it is not shown in the drawings.

Figure 38:
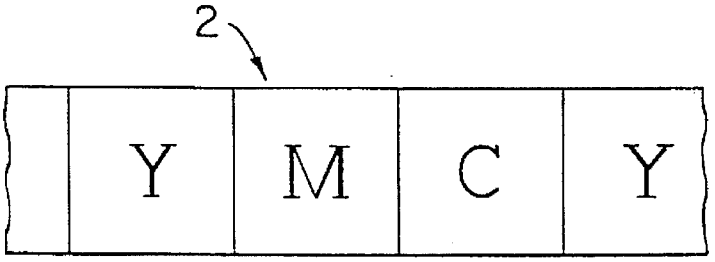
FIG. 38 is a plane view of a thermal transfer sheet on which areas of dyes of different colors are sequentially provided.

A conventionally-known heat transfer printing sheet used in the hot-melt transfer printing process or in the sublimation transfer printing process can be used as it is. In order to form a colored image by transferring three colors of yellow, magenta and cyan (or four colors of the three colors and black), placing the colors one over another, either three (or four) heat transfer printing sheets, each having a coloring material layer of one of the three (or four) colors, or a heat transfer sheet on which areas of the three colors are sequentially provided as shown in FIG. 38 can be used. Further, it is also possible to form images by applying the hot-melt transfer printing process and the sublimation transfer printing process in combination. For example, a heat transfer printing sheet for the hot-melt transfer printing process is used for forming letters or line drawings, and a heat transfer printing sheet for the sublimation transfer printing process is used for forming photograph-like images. In this case, areas of a hot-melt ink layer and dye layers of three colors of yellow, magenta and cyan may be sequentially provided on one heat transfer printing sheet as shown in FIG. 38.

Any conventionally-known means for applying thermal energy can be used in order to transfer the coloring material to the image-receiving layer of the intermediate transfer recording medium.

The image finally obtained on the image-receiving material and the image formed on the intermediate transfer recording medium are in the relation of an object to its reflected image. It is therefore necessary to form a reversed image on the intermediate transfer recording medium.

When a line heater is used to transfer the image-receiving layer of an intermediate transfer recording medium to a printing sheet, the image-receiving layer can be heated more uniformly than by a thermal head, and the heating can be controlled easily. The line heater can respond to heat more quickly than a hot stamper, a heat roller or the like; and the surface temperature of the line heater can also be precisely controlled. Moreover, an apparatus for recording can also be simplified and made small. It is relatively easy to change the transfer area of the image-receiving layer by changing the shape of the heating element, or by ON-OFF control of energy applied to the line heater, or by controlling the patterning of the transfer area in the direction of feeding, such as the raising or lowering of the line heater.

What is claimed is:

1. A method of thermal transfer printing, comprising the steps of:

providing an intermediate transfer recording medium made up of a substrate sheet and an image-receiving layer releasably attached to one surface of the substrate sheet, said image-receiving layer having an image forming area;

providing a thermal transfer sheet having a coloring material layer including a coloring material on one surface thereof;

passing said transfer recording medium and said thermal transfer sheet between heating means and platen means under pressure with said image-receiving layer facing said coloring material layer;

operating the heating means in accordance with image information to heat the coloring material layer to cause said coloring material to migrate from the coloring material layer to the image forming area of the image-receiving layer, thereby forming an image in the image forming area, the above steps constituting an image forming step;

superposing a printing sheet on the image-receiving layer, having the image formed therein, of the intermediate transfer recording medium;

applying heat and/or pressure to the printing sheet and the transfer recording medium to transfer-print the image in the image-receiving layer onto the printing sheet, said superposing and applying steps constituting an image transfer step; and determining position of said image forming area in said image forming step by detecting a detection mark provided on the intermediate transfer recording medium.

2. The method according to claim 1, further comprising the step of:

providing said detection mark preliminarily on the intermediate transfer recording medium when the medium is prepared.

3. The method according to claim 1, further comprising the step of:

providing said detection mark on the intermediate transfer recording medium when the image is formed on the image-receiving layer.

4. The method according to claim 1, further comprising the steps of:

providing said thermal transfer sheet with a second coloring material layer including a second coloring material;

operating the heating means to heat the second coloring material layer to cause the second coloring material to migrate to the image forming area of the image-receiving layer, thereby forming a multicolor image in the image forming area;

providing said detection mark before said second coloring material is migrated to the image forming area; and detecting the detection mark for positioning when an image of the second coloring material is formed in the image forming area.

5. A method of thermal transfer printing, comprising the steps of:

providing an intermediate transfer recording medium made up of a substrate sheet and an image-receiving layer releasably attached to one surface of the substrate sheet, said image-receiving layer having an image forming area;

providing a thermal transfer sheet having a coloring material layer including a coloring material on one surface thereof;

passing said transfer recording medium and said thermal transfer sheet between heating means and platen means under pressure with said image-receiving layer facing said coloring material layer;

operating the heating means in accordance with image information to heat the coloring material layer to cause said coloring material to migrate from the coloring material layer to the image forming area of the image-receiving layer, thereby forming an image in the image forming area, the above steps constituting an image forming step;

superposing a printing sheet on the image-receiving layer, having the image formed therein, of the intermediate transfer recording medium;

applying heat and/or pressure to the printing sheet and the transfer recording medium to transfer-print the image in the image-receiving layer onto the printing sheet, said superposing and applying steps constituting an image transfer step; and determining position of said image forming area in said image transfer step by detecting a detection mark provided on the intermediate transfer recording medium.

6. The method according to claim 5, further comprising the step of:

providing said detection mark preliminarily on the intermediate transfer recording medium when the medium is prepared.

7. The method according to claim 5, further comprising the step of:

providing said detection mark at a predetermined position relative to said image forming area before the image in the image forming area is transferred to the printing sheet.

8. A method of thermal transfer printing, comprising the steps of:

providing an intermediate transfer recording medium made up of a substrate sheet and an image-receiving layer releasably attached to one surface of the substrate sheet, said image-receiving layer having an image forming area;

providing a thermal transfer sheet having a coloring material layer including a coloring material on one surface thereof;

passing said transfer recording medium and said thermal transfer sheet between heating means and platen means under pressure with said image-receiving layer facing said coloring material layer;

operating the heating means in accordance with image information to heat the coloring material layer to cause said coloring material to migrate from the coloring material layer to the image forming area of the image-receiving layer, thereby forming an image in the image forming area, the above steps constituting an image forming step;

superposing a printing sheet on the image-receiving layer, having the image formed therein, of the intermediate transfer recording medium;

applying heat and/or pressure to the printing sheet and the transfer recording medium to transfer-print the image in the image-receiving layer onto the printing sheet, said superposing and applying steps constituting an image transfer step; and determining position of said image forming area during said image forming step by detecting a detection mark provided on the intermediate transfer recording medium; and determining position of said image forming area during said image transfer step by detecting said detection mark.

9. The method according to claim 8, further comprising the step of:

providing said detection mark preliminarily on the intermediate transfer recording medium when the medium is prepared.

10. The method according to claim 8, further comprising the step of:

providing said detection mark on the intermediate transfer recording medium when the image is formed on the image-receiving layer.

11. The method according to claim 8, further comprising the steps of:

providing said thermal transfer sheet with a second coloring material layer including a second coloring material;

operating the heating means to heat the second coloring material layer to cause the second coloring material to migrate to the image forming area of the image-receiving layer, thereby forming a multicolor image in the image forming area;

providing said detection mark before said second coloring material is migrated to the image forming area; and detecting the detection mark for positioning when an image of the second coloring material is formed in the image forming area.

12. An apparatus for thermal transfer printing, comprising:

means for feeding a thermal transfer sheet having a coloring material layer including a coloring material on one surface thereof;

means for feeding an intermediate transfer recording medium made up of a substrate sheet and an image-receiving layer releasably attached to one surface of the substrate sheet in such a manner that the transfer recording medium will be conveyed together with the thermal transfer sheet along a path with the image-receiving layer facing the coloring material layer;

heating means provided alongside said path to heat the coloring material layer in accordance with image information to cause the coloring material to migrate from the coloring material layer to an image forming area of the image-receiving layer, thereby forming an image in the image forming area;

platen means for pressing said thermal transfer sheet and the intermediate transfer recording medium against said heating means; and detection means for detecting a detection mark provided on said intermediate transfer recording medium and for positioning the image forming area of the transfer recording medium relative to said heating means when the image is formed in the image forming area.

13. An apparatus for thermal transfer printing, comprising:

means for feeding a printing sheet;

means for feeding an intermediate transfer recording medium made up of a substrate sheet and an image-receiving layer releasably attached to one surface of the substrate sheet in such a manner that the transfer recording medium will be conveyed together with the printing sheet along a path with the image-receiving layer facing the printing sheet, said image-receiving layer including an image-receiving area in which an image has been formed;

heating means provided alongside said path to heat the transfer recording medium to transfer the image-receiving layer to the printing sheet, thereby to transfer-print the image to the printing sheet;

platen means for pressing the transfer recording medium and the printing sheet against the heating means; and detection means for detecting a detection mark provided on said intermediate transfer recording medium and for positioning the image forming area of the medium relative to said heating means when the image-receiving layer is transferred from said medium to the printing sheet.

14. An apparatus for thermal transfer printing, comprising:

means for feeding a thermal transfer sheet having a coloring material layer including a coloring material on one surface thereof;

first means for feeding an intermediate transfer recording medium made up of a substrate sheet and an image-receiving layer releasably attached to one surface of the substrate sheet in such a manner that the transfer recording medium will be conveyed together with the thermal transfer sheet along a first path with the image-receiving layer facing the coloring material layer;

first heating means provided alongside said first path to heat the coloring material layer in accordance with image information to cause the coloring material to migrate from the coloring material layer to an image forming area of the image-receiving layer, thereby forming an image in the image forming area;

first platen means for pressing said thermal transfer sheet and the intermediate transfer recording medium against said heating means;

first detection means for detecting a detection mark provided on said intermediate transfer recording medium and for positioning the image forming area of the transfer recording medium relative to said heating means when the image is formed in the image forming area;

means for feeding a printing sheet;

second means for further feeding the intermediate transfer recording medium in such a manner that the transfer recording medium will be conveyed together with the printing sheet along a second path with the image-receiving layer facing the printing sheet, said image-receiving layer having the image formed therein;

second heating means provided alongside said second path to heat the transfer recording medium to transfer the image-receiving layer to the printing sheet, thereby to transfer-print the formed image to the printing sheet;

second platen means for pressing the transfer recording medium and the printing sheet against the second heating means; and second detection means for detecting the detection mark on said intermediate transfer recording medium and for positioning the image forming area of the medium relative to said second heating means when the image-receiving layer is transferred from said medium to the printing sheet.

15. An apparatus for thermal transfer printing, comprising:

an image forming section and an image transfer section;

said image forming section including:

means for feeding a thermal transfer sheet having a coloring material layer including a coloring material on one surface thereof;

first means for feeding an intermediate transfer recording medium made up of a substrate sheet and an image-receiving layer releasably attached to one surface of the substrate sheet in such a manner that the transfer recording medium will be conveyed together with the thermal transfer sheet along a first path with the image-receiving layer facing the coloring material layer;

first heating means provided alongside the first path to heat the coloring material layer in accordance with image information to cause the coloring material to migrate from the coloring material layer to an image forming area of the image-receiving layer, thereby forming an image in the image forming area; and first platen means for pressing said thermal transfer sheet and the intermediate transfer recording medium against said first heating means;

said image transfer section including:

means for feeding a printing sheet;

second means for further feeding the intermediate transfer recording medium in such a manner that the transfer recording medium will be conveyed together with the printing sheet along a second path with the image-receiving layer facing the printing sheet;

second heating means provided alongside the second path to heat the transfer recording medium to transfer the image-receiving layer to the printing sheet, thereby to transfer-print the formed image to the printing sheet; and second platen means for pressing the transfer recording medium and the printing sheet against the second heating means;

said apparatus further comprising:

buffer means provided between said image forming section and said image transfer section in association with said intermediate transfer recording medium for adjusting the length of the medium between the two sections.

16. The apparatus according to claim 15, further comprising:

means provided between the image forming section and the buffer means for applying tension to the intermediate transfer recording medium.

17. The apparatus according to claim 15, further comprising:

a supply roll for paying out the intermediate transfer recording medium; and means provided at said supply roll to apply tension to said medium.

18. The apparatus according to claim 15, further comprising:

a supply roll for paying out the intermediate transfer recording medium; and means provided between the supply roll and said first platen means for applying tension to said medium.

19. The apparatus according to claim 15, further comprising:

means provided between the buffer means and the image transfer section for applying tension to the intermediate transfer recording medium.

20. The apparatus according to claim 15, further comprising:

a supply roll for paying out the thermal transfer sheet; and means provided at said supply roll for the transfer sheet for applying tension to the transfer sheet.

21. A method of thermal transfer printing, comprising the steps of:

providing an intermediate transfer recording medium made up of a substrate sheet and an image-receiving layer releasably attached to one surface of the substrate sheet, said image-receiving layer having an image forming area;

providing a thermal transfer sheet having a coloring material layer including a coloring material on one surface thereof;

passing said transfer recording medium and said thermal transfer sheet between heating means and platen means under pressure with said image-receiving layer facing said coloring material layer;

operating the heating means in accordance with image information to heat the coloring material layer to cause said coloring material to migrate from the coloring material layer to the image forming area of the image-receiving layer, thereby forming an image in the image forming area, the above steps constituting an image forming step;

superposing a printing sheet on the image-receiving layer, having the image formed therein, of the intermediate transfer recording medium; and applying heat and/or pressure to the printing sheet and the transfer recording medium to transfer-print the image in the image-receiving layer onto the printing sheet, said superposing and applying steps constituting an image transfer step, said step of applying heat and/or pressure being carried out with a line heater.

22. The method according to claim 21, further comprising the step of:

detecting the temperature of the line heater; and controlling the temperature.

23. An apparatus for thermal transfer printing, comprising:

means for feeding a printing sheet;

means for feeding an intermediate transfer recording medium made up of a substrate sheet and an image-receiving layer releasably attached to one surface of the substrate sheet in such a manner that the transfer recording medium will be conveyed together with the printing sheet along a path with the image-receiving layer facing the printing sheet, said image-receiving layer including an image-receiving area in which an image has been formed;

heating means in the form of a line heater provided alongside the path to heat the transfer recording medium to transfer the image-receiving layer to the printing sheet, thereby to transfer-print the image to the printing sheet; and platen means for pressing the transfer recording medium and the printing sheet against the heating means.

24. An apparatus for thermal transfer printing, comprising:

means for feeding a thermal transfer sheet having a coloring material layer including a coloring material on one surface thereof;

first means for feeding an intermediate transfer recording medium made up of a substrate sheet and an image-receiving layer releasably attached to one surface of the substrate sheet in such a manner that the transfer recording medium will be conveyed together with said thermal transfer sheet along a first path with the image-receiving layer facing the coloring material layer;

first heating means provided alongside said first path to heat the coloring material layer in accordance with image information to cause the coloring material to migrate from the coloring material layer to an image forming area of the image-receiving layer, thereby forming an image in the image forming area;

first platen means for pressing said thermal transfer sheet and the intermediate transfer recording medium against said heating means;

means for feeding a printing sheet;

second means for further feeding said intermediate transfer recording medium in such a manner that the transfer recording medium will be conveyed together with said printing sheet along a second path with the image-receiving layer facing the printing sheet, said image-receiving layer having the image formed therein;

second heating means in the form of a line heater provided alongside said second path to heat the transfer recording medium to transfer the image-receiving layer to the printing sheet, thereby to transfer-print the formed image to the printing sheet; and second platen means for pressing the transfer recording medium and the printing sheet against the second heating means.

25. The apparatus according to claim 24, further comprising:

temperature sensing means for detecting the temperature of the line heater; and means responsive to the detected temperature to control the line heater.

* * * * *